US006734712B2

(12) United States Patent
Holdenried et al.

(10) Patent No.: US 6,734,712 B2
(45) Date of Patent: May 11, 2004

(54) LOGARITHMIC AMPLIFIER

(75) Inventors: Christopher D. Holdenried, Calgary (CA); James W. Haslett, Calgary (CA); John G. McRory, Calgary (CA); Robert J. Davies, Calgary (CA)

(73) Assignee: Telecommunications Research Laboratories, Edmonton (CA)

( * ) Notice: Subject to any disclaimer, the term of this patent is extended or adjusted under 35 U.S.C. 154(b) by 0 days.

(21) Appl. No.: 10/156,731

(22) Filed: May 24, 2002

(65) Prior Publication Data

US 2003/0030479 A1 Feb. 13, 2003

Related U.S. Application Data

(60) Provisional application No. 60/304,475, filed on Jul. 10, 2001.

(51) Int. Cl.[7] ..... G06G 7/24

(52) U.S. Cl. ..... 327/350; 327/351; 327/352

(58) Field of Search ..... 327/350, 351, 327/352, 358, 359, 361

(56) References Cited

U.S. PATENT DOCUMENTS

| | | | | | |
|---|---|---|---|---|---|
| 3,745,474 | A | | 7/1973 | Hughes | 328/145 |
| 4,257,126 | A | | 3/1981 | Theall, Jr. | 455/619 |
| 4,531,069 | A | | 7/1985 | Parker | 307/492 |
| 4,990,803 | A | | 2/1991 | Gilbert | 307/492 |
| 5,049,829 | A | * | 9/1991 | Garskamp et al. | 328/145 |
| 5,221,907 | A | | 6/1993 | Olsen et al. | 328/145 |
| 5,298,811 | A | | 3/1994 | Gilbert | 307/492 |
| 5,414,313 | A | * | 5/1995 | Crescenzi, Jr. et al. | 327/351 |
| 5,506,537 | A | | 4/1996 | Kimura | 327/351 |
| 5,949,926 | A | | 9/1999 | Davies | 385/3 |
| 6,144,244 | A | * | 11/2000 | Gilbert | 327/350 |

OTHER PUBLICATIONS

A 60 dB Gain, 55–dB Dynamic Range, 10–Gb/s Broad–Band SiGe HBT Limiting Amplfier, Yuriy M. Greshishchev and Peter Schvan, IEEE Journal of Solid–State Circuits, vol. 34, No. 12, Dec. 1999, pp. 1914–1920.

A True Logarithmic Amplifier for Radar IF Applications, William L. Barber and Edmund R. Brown, IEEE Journal of Solid–State Circuits, vol. SC–15, No. 3, Jun. 1980, pp. 291–295.

A True I.F. Logarithmic Amplifier using Twin–Gain Stages, A. Woroncow and J. Croney, The Radio and Electronic Engineer, Sep. 1966, pp. 149–155.

High–Performance GaAs Heterojunction Bipolar Transistor Logarithmic IF Amplifier, A.K. Oki et al., IEEE 1988 Microwave and Millimeter–Wave Monolithic Circuits Symposium, pp. 41–45.

(List continued on next page.)

*Primary Examiner*—Tuan T. Lam
*Assistant Examiner*—Hiep Nguyen
(74) *Attorney, Agent, or Firm*—Christensen O'Connor Johnson Kindness

(57) ABSTRACT

A parallel-summation logarithmic amplifier is described that uses a novel topology of cascaded and parallel amplifiers to achieve extremely high bandwidth. Included in the topology is a unique delay matching scheme for logarithmic amplifiers that is amenable to fabrication in integrated circuit form. The result is flat group delay over broad frequency ranges and different power levels. The resulting log amplifier is suitable for radar applications and for use in high data rate fiber-optic networks. Also described is a unique design process that yields a set of amplifier gains that closely approximate a logarithm. Also described is the novel idea of using a parallel feedback amplifier (PFA) in piecewise-approximate logarithmic amplifiers. This innovation allows for the design of broadband amplifiers with significantly different gains and similar phase characteristics, which is extremely useful when designing high-frequency logarithmic amplifiers.

32 Claims, 20 Drawing Sheets

OTHER PUBLICATIONS

A 0.5 to 4 GHz True Logarithmic Amplifier Utilizing Monolithic GaAs MESFET Technology, Mark A. Smith, IEEE Transactions on Microwave Theory and Techniques, vol. 36, No. 12, Dec. 1988, pp. 1986–1990.

A GaAs MMIC for a 2–7 GHz Successive Detection Logarithmic Amplifier, L.W. Chua, IEEE 1992 Microwave and Millimeter–Wave Monolithic Circuits Symposium, pp. 145–148.

A GaAs MMIC Based Successive Detection Logarithmic Amplifier, Desmond J. Nelly and Daniel S. Parsons, IEEE 1992 Microwave and Millimeter–Wave Monolithic Circuits Symposium, pp. 149–151.

High–Performance GaAs Heterojunction Bipolar Transistor Monolithic Logarithmic IF Amplifiers, A.K. Oki et al., IEEE Transactions on Microwave Theory and Techniques, vol. 36, No. 12, Dec. 1988, pp. 1958–1965.

Wide–Band Logarithmic Amplifier, A.A. Yanishevskiy, translation from Radiotekhnika, vol. 32, Issue 10, published Oct. 1977, pp. 149–143.

Try a piecewise–linear approach to the design of wide–range log amplifiers and get more accurate transfer characteristics and faster response, George Smith 3d, University of Manitoba, Electronic Design 1, Jan. 6, 1972, pp. 66–70.

A UHF True Logarithmic IF Amplifier, B. Loesch, IEEE Transactions on Aerospace and Electronic Systems, vol. AES–9, No. 5, Sep. 1973, pp. 660–664.

Wide–range logamps scale 0.4 to 2.0 GHz, Eric Schmidt and Kevin Comeau, Microwaves and RF, Dec. 1986, pp. 167–168.

Extremely fast logamp handles narrow pulses, David Potson and Richard Smith Hughes, Microwaves and RF, Apr. 1985, 5 pages.

A Monolithic GaAs Low Power L–Band Successive Detection Logarithmic Amplifier, N. Scheinberg and R. Michels, IEEE Journal of Solid–State Circuits, vol. 29, No. 2, Feb. 1994, pp. 151–154.

2–18 GHz Logarithmic Amplification Componentry, Eitan Gertel et al., 1990 IEEE MTT–S Digest, pp. 1093–1096.

A guide to specifying and testing logarithmic devices, Dan Scheingold and John Cadogan, EDN Dec. 20, 1973, pp. 54–58.

An Eight–Stage Log Amplifier, Diep Tran–Nguyen, RF Design, Nov. 1986, pp. 84–89.

Specifying Logarithmic Amplifiers for Defense Applications, James Bean et al., Microwave Journal, Jun. 1988, 7 pages.

An L–Band Temperature Compensated Ultra Low Power Successive Detection Logarithmic Amplifier, R. Michels et al., 1989 IEEE MTT–S Digest, pp. 541–544.

Novel decade–bandwidth microwave true logarithmic amplifier, G. Acciari et al., Electronics Letters, vol. 32, No. 5, Feb. 29, 1996, pp. 464–465.

Theory and performance of parabolic true logarithmic amplifier, G. Acciari et al., IEE Proc.–Circuits Devices Syst., vol. 144, No. 4, Aug. 1997, pp. 223–228.

An Anti–Clutter Radar Receiver, R.V. Alred et al., Proc. Instn Elect. Engrs, 95, Pt. III, No. 38, Nov. 1948, pp. 459–465.

A GaAs Monolithic True Logarithmic Amplifier for 0.5 to 4 GHz Applications, Mark A. Smith, IEEE 1988 Microwave and Millimeter–Wave Monolithic Circuits Symposium, pp. 37–39.

A Logarithmic Distributed Amplifier, N. Nazoa–Ruiz and C.S. Aitchison, 1990 IEEE MTT–S Digest, pp. 753–756.

Current ratio log amplifier using light emitting diodes, R.N. Misra and Y.B. Acharya, Int. J. Electronics, vol. 53, No. 1, 1982, pp. 91–94.

A GaAs HBT Monolithic Logarithmic IF (0.5 t0 1.5 GHz) Amplifier with 60 dB Dynamic Range and 400 mW Power Consumption, G.M. Gorman et al., 1989 IEEE MTT–S Digest, pp. 537–540.

* cited by examiner

LOGARITHMIC AMPLIFIER

CROSS-REFERENCE TO RELATED APPLICATION

This application claims the benefit of the filing date of U.S. Provisional Application No. 60/304,475 filed Jul. 10, 2001.

BACKGROUND OF THE INVENTION

A logarithmic amplifier is a device that provides an output signal that will increment by a fixed amount each time the input signal increases by some factor. For example, a log amplifier may be designed to increment its output signal in response to a tripling or quadrupling of the input signal.

Early developments in logarithmic amplifiers came from the need to create a form of automatic gain control with high dynamic range in receivers for radar and electronic warfare. In these applications, the received signal power can vary by many orders of magnitude due to obstructions and reflections in the transmitting path. Logarithmic amplifiers are used to compress this large signal range into a smaller range that is more easily monitored on an electronic display or more easily captured with an analog-to-digital converter. Furthermore, a log amplifier may be used wherever the need for logarithmic arithmetic arises in instrumentation and signal processing in general.

Logarithmic amplifiers may also be used in fiber-optic receivers for gain control. The detected power in a fiber-optic receiver can vary due to bias point drift in both the transmitting laser and the receiver photodiode. Logarithmic amplifiers have been used to compress the high range of power levels provided by the photodiode. The advantage is to ease the task of the decision circuitry within the receiver and to protect it from optical overload.

Logarithmic converters may also be used in optical transmitters to aid in the task of performing single-sideband modulation of optical signals. An optical modulation system 10 that uses a logarithmic converter is shown in FIG. 1. An electrical information signal 100 is input to an optical amplitude modulator 104, and so the information signal amplitude-modulates the optical signal 102. As well, the signal is input to a logarithmic converter 106 serially coupled to a Hilbert transformer 108. Using an optical phase modulator 110, the output of the Hilbert transformer is used to phase-modulate the output of the optical amplitude modulator. The output of the phase modulator is an optical single-sideband signal 112. This scheme is particularly suited to high-data rate, baseband digital signals. The modulator is further described in U.S. Pat. No. 5,949,926.

There are two general categories of logarithmic converters; single stage converters and piecewise-approximate converters. Single stage converters, such as those that exploit the exponential voltage-to-current relation of PN junctions in bipolar transistors and diodes, provide efficient logarithmic conversion in low frequency applications. However, the present invention is concerned with high frequency operation and so only converters providing a piecewise-approximation to a logarithm are considered.

Piecewise-approximate logarithmic amplifiers may be subdivided into those that operate in a 'true' mode (also called 'baseband' or 'video'), or a demodulating mode, or those that may operate in both modes. Demodulating logarithmic amplifiers provide the logarithm of the envelope of the input signal, as opposed to the logarithm of the entire signal provided by true logarithmic amplifiers. The present invention is primarily concerned with improving logarithmic amplifiers operating in the true mode, and so the demodulating ability of logarithmic amplifiers will not be discussed further here.

A progressive-compression logarithmic amplifier 20 is shown in FIG. 2. The signal path includes serially coupled amplifiers 204, with the output voltage of each amplifier coupled to a limiting transconductance element 206. The unamplified input signal is coupled to limiting transconductance element 206A that has a higher gain than elements 206. FIG. 3 parts (a) and (b) show the input-output characteristic of transconductance elements 206 and 206A respectively. A current bus 208 sums the output currents of all such elements to provide a system output current that is logarithmically related to the input signal 202. Typically the current bus is terminated by a resistive element 210 to provide an output voltage 212. Since the currents are summed in parallel, amplifier 20 belongs to the class of parallel summation logarithmic amplifiers.

In the progressive-compression amplifier in FIG. 2, relatively small input signals are simply amplified, whereas larger signals will cause the transconductance elements in each path to limit, starting with the last path and progressing toward the first path. FIG. 4 shows the DC response 402 of amplifier 20, where the transfer function of a four-path progressive-compression amplifier is shown. The amplifier response approximates a straight line in FIG. 4 because it is plotted on a semi-logarithmic axis. In order to reduce the error between the cusps of the approximation, more stages with smaller gains must be cascaded.

Progressive-compression amplifiers take advantage of multiple cascaded amplifiers to provide high gain. High gain directly translates into high dynamic range, because the logarithmic dynamic range extends from the point where the gain is highest to where the gain compresses to zero. In addition, progressive-compression amplifiers are easy to design since all of the cascaded stages are the same or similar. They also exhibit high tolerance to manufacturing process and temperature variations since these factors are likely to effect the gain of amplifiers 204 equally, which will simply shift or scale the logarithmic response without significantly distorting its logarithmic characteristics.

A limit on the frequency range of the progressive-compression amplifier may be seen by considering that the component amplifiers 204 each have finite bandwidth. If a single pole dominates the frequency response of these amplifiers, then the phase response of each amplifier will be close to −45 degrees near the pole frequency. The input signal 202 in FIG. 2 will pass through element 206A to the current bus with little phase shift, and this signal must be added in parallel with the output of the last serially-coupled amplifier 204 which will have significant phase shift from having passed through several amplifiers. Hence, if out-of-phase addition is to be avoided, either the amplifier must be operated well below its frequency limit, or the signals with little phase delay must have phase delay added to them prior to summation.

Another type of serially coupled logarithmic converter that exhibits better internal phase matching is the series linear-limit logarithmic amplifier 50 shown in FIG. 5, also known as the twin-gain stage logarithmic amplifier from A. Woroncow and J. Croney, "A True I.F. Logarithmic Amplifier using Twin-Gain Stages", The Radio and Electronic Engineer, September 1966, pp. 149–155. A number of identical stages 508 consisting of a limiting amplifier 506 in parallel with a buffering network 502 are cascaded. An input signal 504 that is relatively small will simply be amplified by all stages, while larger signals will cause the limiting amplifiers 506 to limit, starting with the last stage and progressing toward the input. The DC transfer function 404 of a logarithmic amplifier with three twin-gain stages is shown in FIG. 4. It may be seen that the response of the twin-gain stage amplifier is similar to that of the progressive-compression amplifier except beyond point 406. Point 406 approximately indicates the highest power levels handled by the logarithmic amplifier. Correct operation of the twin-gain stage amplifier requires that all of the buffering amplifiers 502 continue to pass the signal up to the input voltage indicated by point 406. The effect of this requirement on the bandwidth of the twin-gain stage 508 may be shown using the schematic diagram of one of the twin-gain stages in FIG. 6.

FIG. 6 shows two parallel differential-pair amplifiers in bipolar integrated circuit technology with shared collector resistance 602. The high-gain limiting amplifier includes transistors 606 and the low gain buffering amplifier includes transistors 604 and resistors 608 which are required to set the gain of the buffer amplifier. Referring to FIG. 5, it is required that the buffer amplifier 502 in the last stage continue to pass the signal, even after the amplifiers 506 in all previous stages limit and contribute a voltage $V_L$. The signal passed through the buffering amplifier in the last stage is thus equal to $(N-1)V_L$. In the schematic diagram in FIG. 6, the value $V_L$ is equal to the product of $I_{high}$ (at 612) and $R_c$. The limiting value of the buffering amplifier, equal to the product of $I_{low}$ (at 610) and $R_c$, must be at least N−1 times higher than $V_L$. For this reason, $I_{low}$ must be at least N−1 times higher than $I_{high}$. However, $I_{high}$ is relatively high in order to achieve the required gain, so $I_{low}$ will be quite high, requiring the use of large, high power devices with high parasitic capacitance. This capacitance will load the high gain stage and lower its bandwidth. One way to ease the output voltage swing requirements on the buffer amplifier is to lower its gain below unity, so that more input power is required in order for it to limit. However, the buffer amplifiers will still have some parasitic capacitance associated with them and this capacitance will still load the high gain amplifier in parallel and lower the bandwidth of the twin-gain stage.

Parallel amplification logarithmic converters overcome problems with internal delay matching and buffering requirements at the cost of decreased logarithmic dynamic range. FIG. 7 shows a parallel logarithmic amplifier 70. The amplifier consists of a single input coupled to a number of parallel voltage amplifiers 702A–N with gains as indicated. The output of each parallel amplifier is limited to the voltage range +\−VL by limiters 704. Since the outputs of the limiters 704 are summed at 706 in parallel just as in amplifier 20, amplifier 70 also belongs to the class of parallel summation logarithmic amplifiers. The gains of the parallel amplifiers 702 may be uniformly scaled by an arbitrary factor, which may reduce the gain of some paths below unity so that attenuators are used in place of amplifiers. The use of attenuators is undesirable in many applications though, since it increases the required input voltage needed to saturate the limiters 704 or requires limiters with lower corner voltages for a given drive power at the logarithmic amplifier input. As well, a large amount of attenuation increases the noise figure of the converter significantly.

Although parallel amplification logarithmic converters exhibit internal delay matching and low group delay distortion overall, they have distinct disadvantages. Since the parallel amplifiers have significantly different gains, it is more difficult than with serially coupled structures to achieve a logarithmic response that is highly tolerant of process variation. In addition, the parallel architecture is at a disadvantage in high-dynamic range applications since it does not exploit the high gain offered by cascaded amplifier structures.

What is needed is a logarithmic amplifier that attains relatively high gain, bandwidth, and efficiency; and internally matched phase and group delay, all with high tolerance to process variation.

SUMMARY OF THE INVENTION

Accordingly, it is one object of the present invention to provide a logarithmic amplifier with matched group delay amongst its internal paths.

It is another object of the invention to provide a logarithmic amplifier with high bandwidth.

Still another object of the invention is to provide a logarithmic amplifier with high dynamic range.

A further object of the invention is to provide a logarithmic amplifier that occupies little area when fabricated on an integrated circuit.

A still further object of the invention is to provide a logarithmic amplifier with low power consumption.

A still further object of the invention is to provide a logarithmic amplifier with high tolerance to process and temperature variation.

A still further object of the invention is to provide a low-noise logarithmic amplifier.

Therefore according to a first aspect of the invention, there is provided a piecewise-approximate logarithmic amplifier. In one embodiment, the amplifier has of a number of different amplification paths, called the gain section, with a summing/limiting circuit that provides the logarithmic output. The highest gain path consists of a cascade of N high gain amplifiers, where N is an integer greater than one. In a further aspect of the invention, there are at least N+2 amplification paths, and these paths share amplifiers as much as possible. The output of each path passes through a circuit that limits the output signal at a certain level, with the limiting level for each path being preferably the same except the limiting level for the lowest gain path, which may be higher. After being limited, the path outputs are summed to form the logarithmic output.

The gains of all paths may be chosen using a unique design procedure, wherein it is shown that these gains result in an exact logarithmic relationship at fixed points on the characteristic between the logarithmic amplifier's input and output signals.

A means is provided for designing the group and phase delay of each path in parallel summation logarithmic amplifiers to be nearly the same. One preferred delay method involves the use of delay amplifiers where the delay is set using capacitive elements. This delay method is used in the novel branch logarithmic amplifier described above, and may also be used to equalize the delay of the signals in a progressive-compression logarithmic amplifier.

The novel idea of using parallel feedback amplifiers (PFAs) as a building block in logarithmic amplifiers is described. PFAs are linear amplifiers that may be designed to have significantly different gains but similar phase characteristics. Hence, if these amplifiers are used as the logarithmic amplifier building block, then delay tuning may be accomplished using only the parasitic capacitances inherent in transistors. PFAs also have a higher bandwidth than standard differential pairs. However, since PFAs are very similar to differential pairs, then they may be used in place of differential pairs in both parallel summation logarithmic amplifiers and in the series linear-limit logarithmic amplifier.

The preferred embodiment of the logarithmic amplifier is DC coupled and uses fully balanced differential-pair amplifiers. Some optional circuits for reducing DC offsets are described. These circuits may be placed in negative feedback around the high-gain components of the logarithmic amplifier, and may be switched on or off.

The branch logarithmic amplifier and a matched delay progressive-compression amplifier have extremely high bandwidth and low group delay distortion. Accordingly, one application of these structures is in the single-sideband optical modulator shown in FIG. 1.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

In this patent document, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements.

Figure 8:
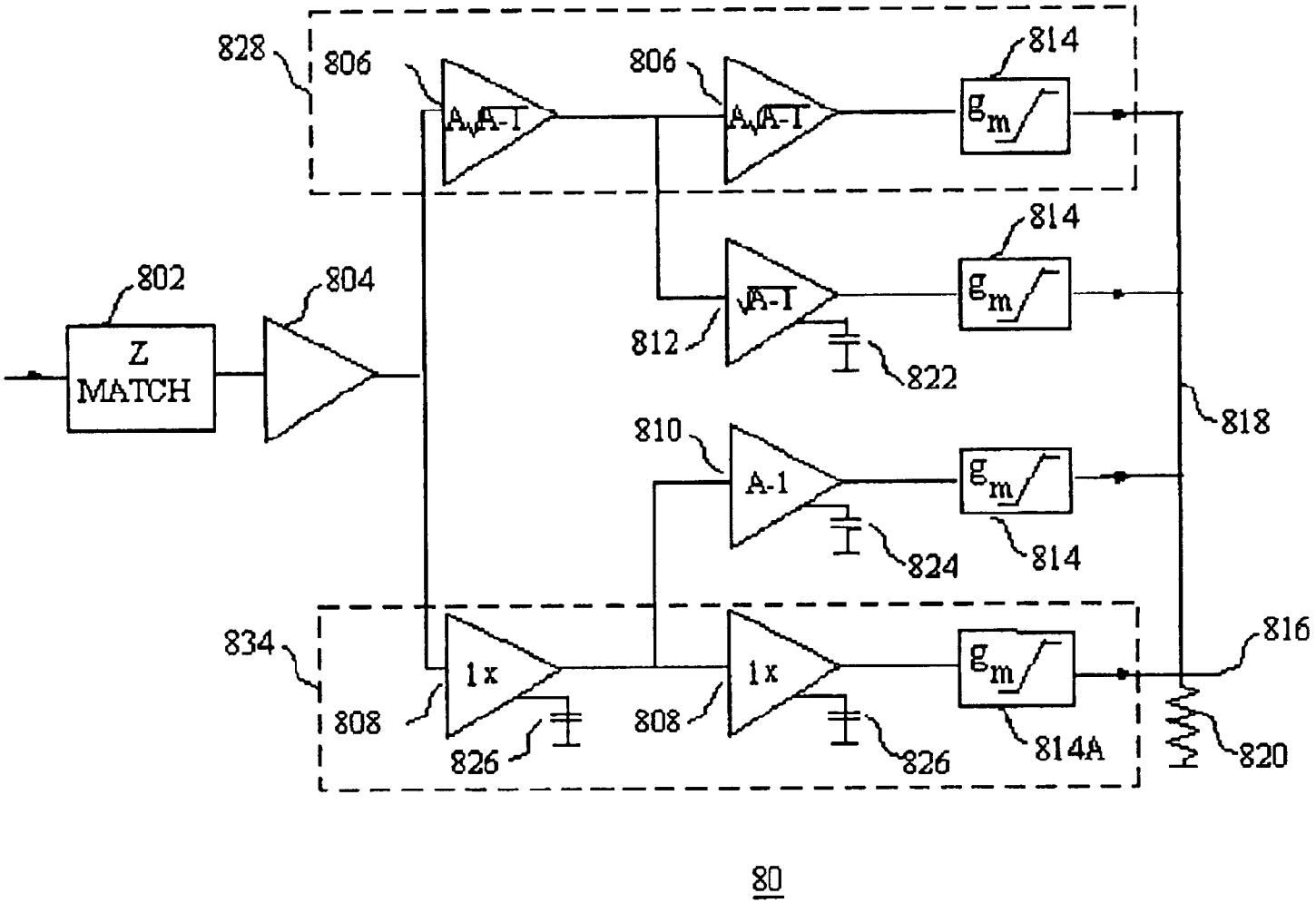
FIG. 8 is a simplified block diagram of one two-stage preferred embodiment.

FIG. 8 shows a two-stage example of the preferred embodiment. For simplicity, only one line is shown connecting each block, although all circuitry may use a pair of differential signals. The input impedance of the logarithmic amplifier is set to 50 Ohms using circuit 802. The noise figure of the overall logarithmic amplifier will be dominated by the noise performance of blocks 802, optional block 804 which may be an amplifier if it is included, and the first high gain amplifier 806. Low noise design recommendations will be given for these blocks as their Schematic diagrams are shown. The highest gain path consists of elements in box 828, and the lowest gain path consists of elements in box 834. The amplifier gains are chosen to provide a logarithmic transfer function for the overall structure, as will be shown in the preferred novel design procedure given later in this section.

Figure 4:
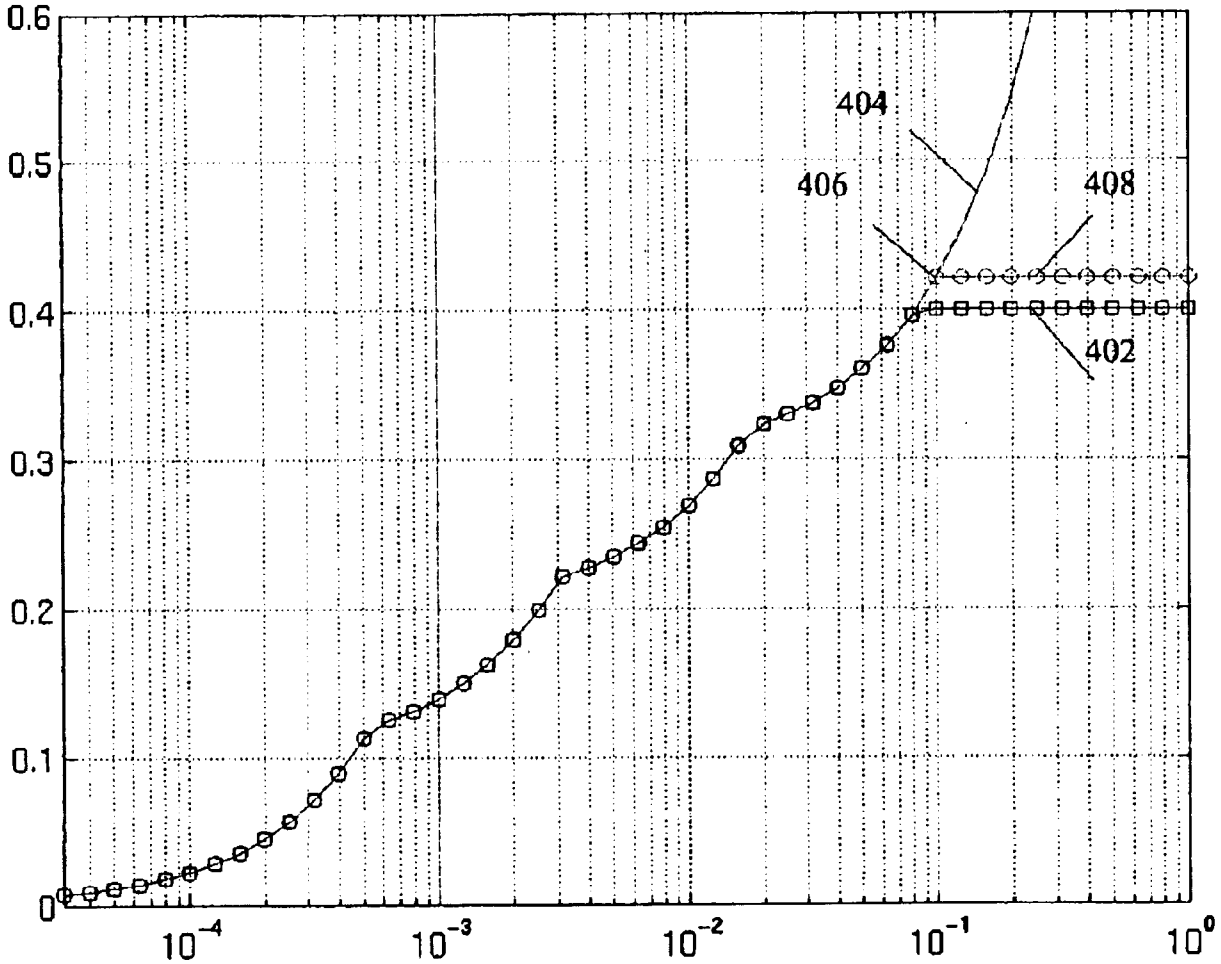
FIG. 4 shows DC logarithmic amplifier responses.

The gains of the highest and lowest gain paths are preferably made as far apart as possible in order to maximize the logarithmic dynamic range. Breaking down the high gain path into a cascade of amplifiers offers an improvement in bandwidth over a single amplifier with the same gain. However, unlike other logarithmic amplifier topologies, preferably only the minimum number of amplifiers required to achieve the desired gain-bandwidth is used, which simplifies the task of simulating the group delay of the high-gain path in the other paths. The DC transfer function of amplifier 80 is shown by curve 408 in FIG. 4.

The two intermediate paths include amplifiers 812 and 810. Since some amplifiers are shared, chip area and power are conserved. In addition, since some paths share a common preamplifier, any process or temperature variations in the shared amplifiers in these paths will affect all succeeding paths equally, providing some tolerance of logarithmic linearity to such effects.

Figure 11:
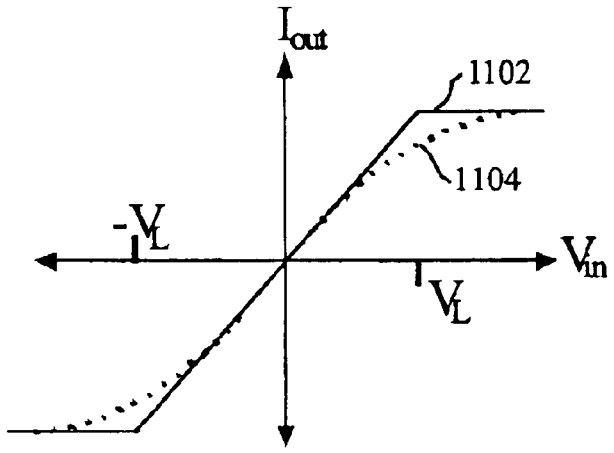
FIG. 11 shows the transfer function of transconductance elements.

Transconductance elements 814 convert amplifier output voltages to currents up to a maximum output current of $+\backslash-I_L$ after which point the output current limits. For improved precision, limiter 814A on the lowest gain path has a larger limiting current such as $+\backslash-I_L A/(A-1)$ as will be shown. Elements 814 and 814A are the signal limiters and ma be referred to as such in this application. The output currents sum on current bus 818, which is terminated by resistance 820 to form the logarithmic output voltage 816. The value of resistor 820 may be 50 Ohms, so that the output impedance of the amplifier is matched to common microwave systems. There is some flexibility in the construction of transconductance elements 814. Their transfer function is shown in FIG. 11, where the solid line 1102 indicates a perfect, symmetrical limiter and the dashed line 1104 shows a more practical hyperbolic tangent limiter. The positive and negative limiting currents of the limiters need not be the sarde.

Figure 9:
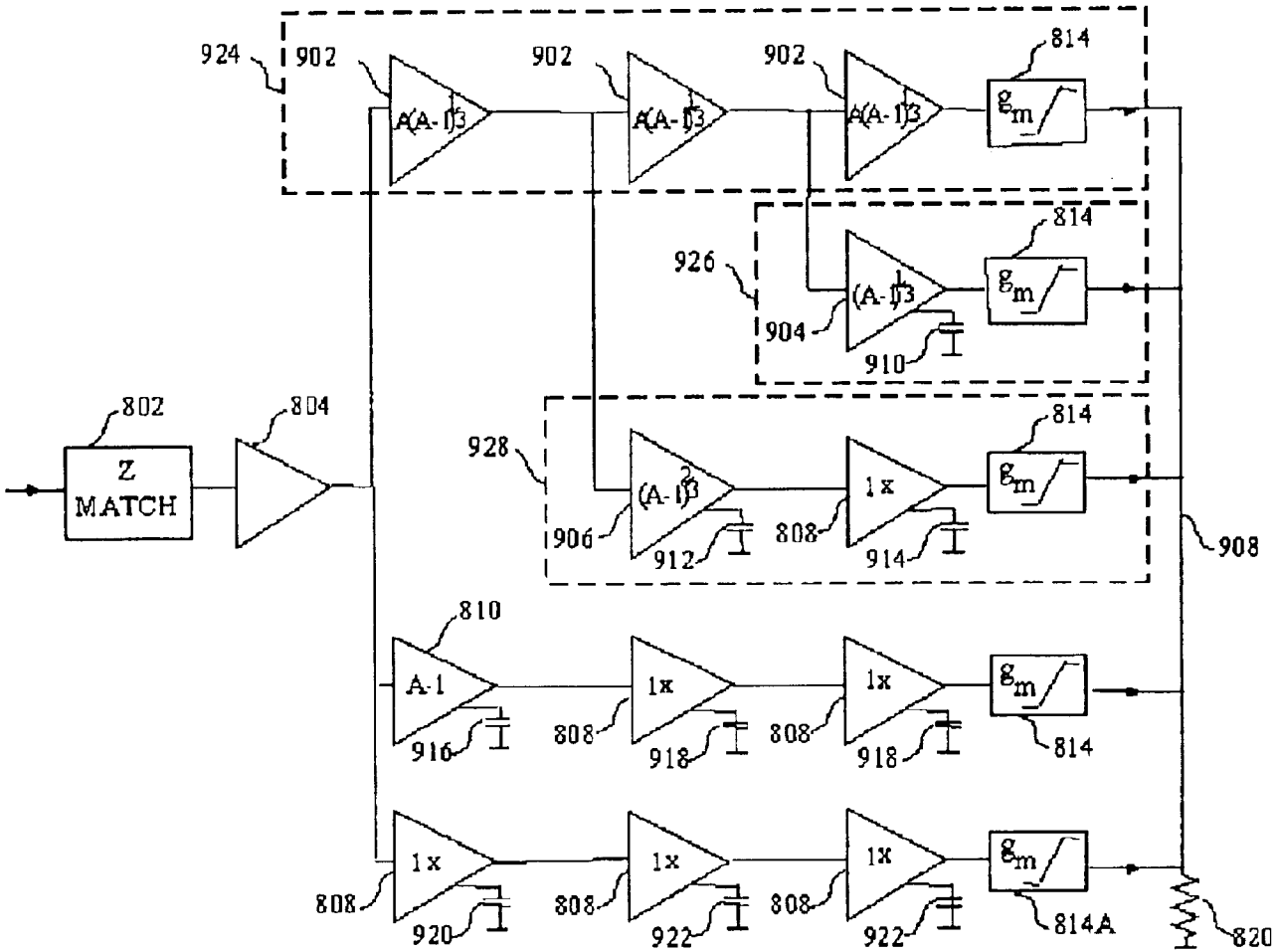
FIG. 9 is a simplified block diagram of one three-stage preferred embodiment.
Figure 10:
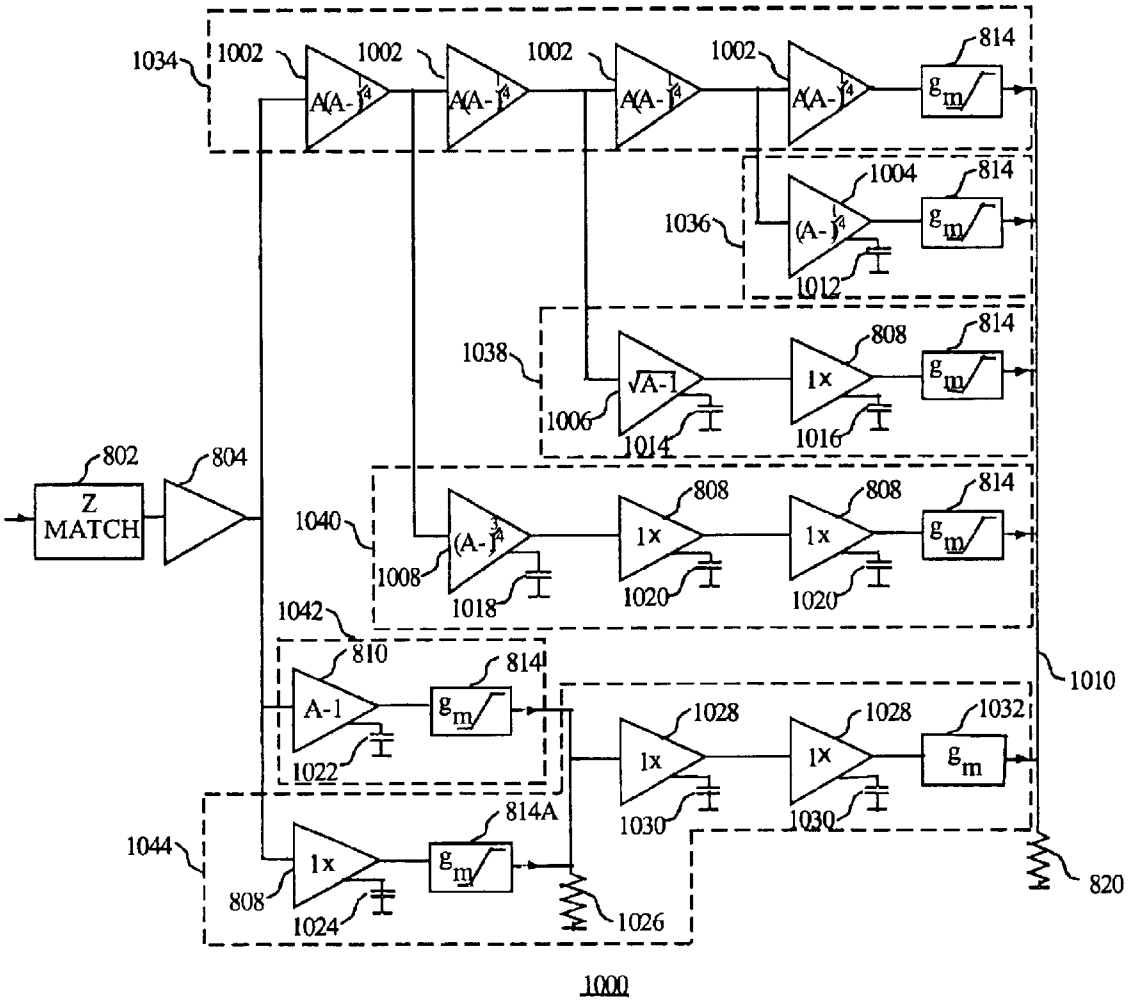
FIG. 10 is a simplified block diagram of one four-stage preferred embodiment.

In applications where increased logarithmic range is wanted, higher order structures such as those shown in FIGS. 9 and 10 are the best choice. Any number of additional intermediate paths may be added, allowing for decreased logarithmic approximation error.

The highest gain path in all of the realizations will have the highest group and phase delay. In order to make the delay through the other paths the same as for this path, a means is provided for delaying the output of the lower gain paths. The method may consist of adding buffering amplifiers, and these amplifiers may contain a capacitive element that is used to increase their delay. This method is used in amplifiers 80 (using capacitative delay elements 822, 824 and 826), 90 (using capacitative delay elements 910–922), and 1000 (using capacitative delay elements 1012–1024 and 1030) in FIGS. 8, 9, and 10 respectively. The values of the capacitors are best determined through a simulation of delay in the different paths. However, the following observation is made about the capacitor values. In FIG. 10, the capacitor 1018 connected to amplifier 1008 is labeled differently and is meant to be smaller than capacitors 1020 connected to the two buffer stages 808 that follow it. This is because the dominant pole limiting the frequency response of 4amplifier 1008 is assumed to be at a lower frequency than the pole of the buffering amplifiers 808 because the pole frequency is lower for a higher gain amplifier. Adding a capacitative element lowers the frequency of this pole, and so lowers the 3 dB bandwidth, and increases the group and phase delay. It is more efficient in terms of maximizing bandwidth to lower the frequency of the pole in each amplifier to roughly the same point, than to lower any one amplifiers pole significantly more than the other amplifiers in that path.

In some branches there are more amplifiers than what is strictly needed to achieve the desired gain. For instance, amplifier 810 in FIG. 8 is in the second lowest gain path but it shares the delay of the first amplifier 808 in the path with the lowest gain. This leads to reduced chip area and power consumption. In contrast, amplifier 810 in FIG. 9 contains all of the gain required for that path, and is followed by two unity-gain buffers. Placing all of the gain as early as possible in a given path offers noise advantages. In FIG. 9, the gain in the highest gain path comprised of elements in 924 is shared between three serially coupled amplifiers 902, while the gain in the next to highest gain path comprised of elements in 926 and the first two amplifiers in box 924 is shared between the first two amplifiers 902 in 924 and amplifier 904 connected in series. The gain in the intermediate gain path comprised of elements in 928 and the first amplifier 902 in 924 with gain of A(A-1) is shared between amplifier 906 and the first amplifier 902 of the highest gain path. The output of the gain paths is summed at current bus 908.

Yet a third alternative, shown in FIG. 10, is to limit and sum the outputs of the two lowest gain paths after the first amplifier and then to buffer the summed signal through amplifiers 1028. This method also saves power and chip area, but inherently reduces the bandwidth of the path with the lowest gain since the signal handling capability of buffering amplifier 1028 must be twice that of amplifier 808, because two signals are being buffered. The exact arrangement of low gain amplifiers used should be chosen based on which requirements are the most stringent. In FIG. 10, the gain in the highest gain path comprised of elements in 1034 is shared between four serially connected amplifiers 1002, while the gain in the next to highest gain path comprised of elements in 1036 and the first three amplifiers 1002 in 1034 is shared between the first three amplifiers 1002 and the amplifier 1004, and so on for the gain paths in 1038 and the first two amplifiers 1002 in 1034 and the path in 1040 and the first amplifier 1002 in 1034. The gain in the intermediate gain path comprised of elements in 1040 and the first amplifier 1002 in 1034 with gain of A(A-1) is shared between amplifier 1008 and the first amplifier 1002 of 1034. The output of the gain paths is summed on summing bus 1010. The two lowest gain paths comprised of elements in 1044 and elements in 1042 and the last three elements in 1044 of FIG. 10 uses the amplifier 810 with buffer amplifier 808 and limiters 814, 814A from FIG. 8, along with buffer amplifiers 1028 and transconductance element 1032.

Figure 12:
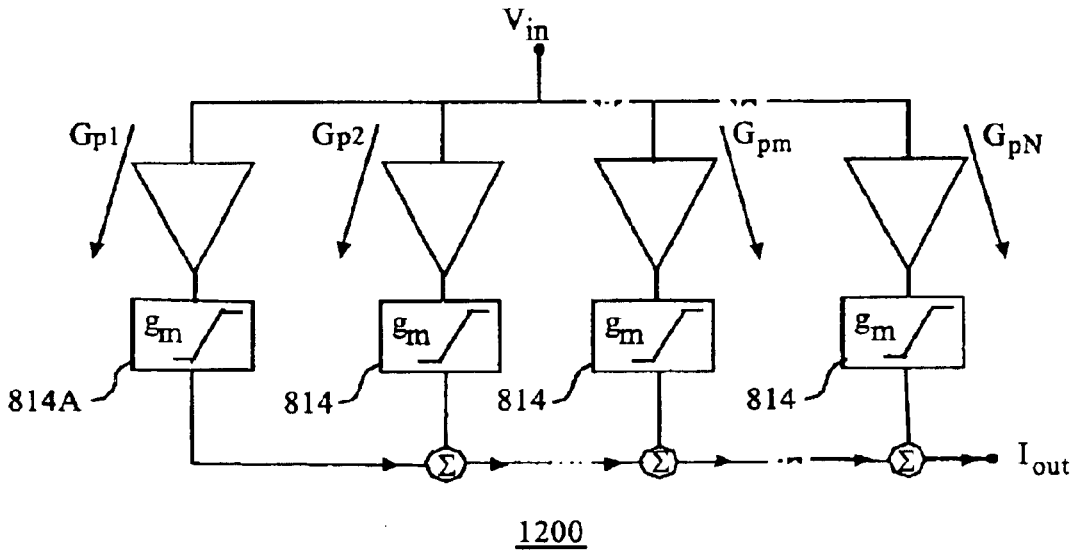
FIG. 12 is a simplified block diagram of a parallel-summation logarithmic amplifier.
Figure 13:
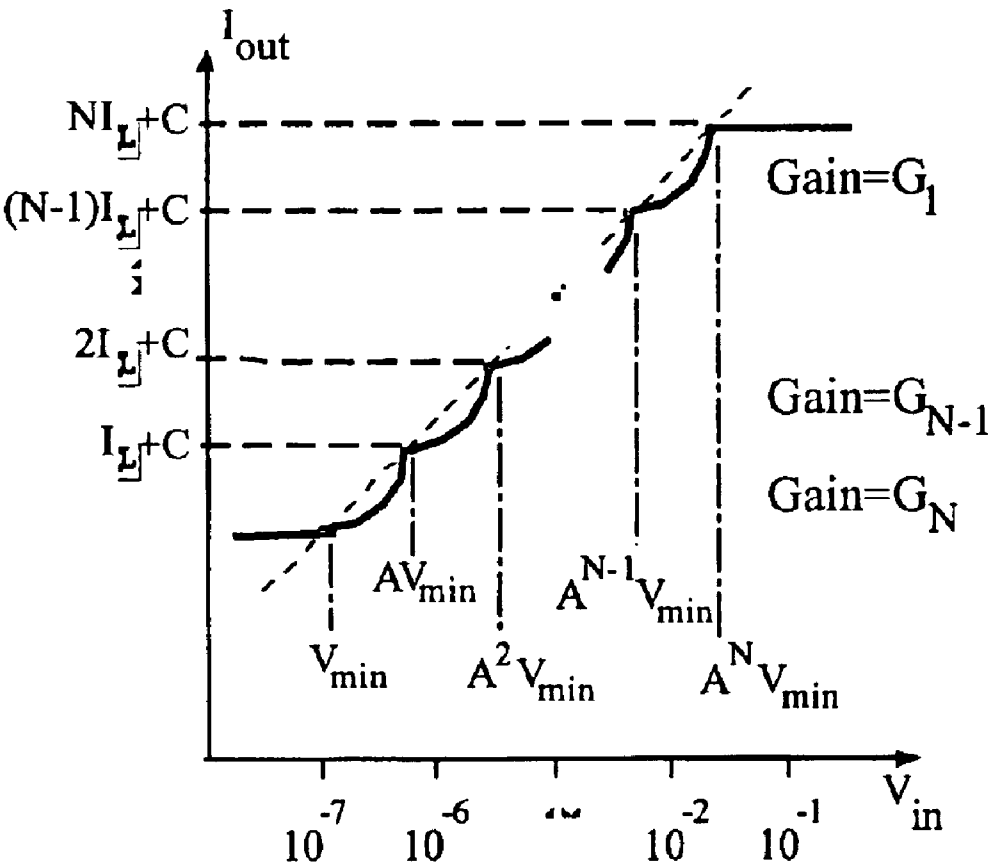
FIG. 13 shows an ideal logarithmic amplifier response.

Having described preferred embodiments of the invention, the novel design procedure behind their creation is now given. Considering the parallel-summation logarithmic amplifier 1200 in FIG. 12, the desired transfer function of this circuit is shown in FIG. 13. Define the constant A as the factor increase in the input voltage between the cusps of the logarithmic approximation. The dynamic range of the logarithmic amplifier will be an $A^N$ change in the input voltage $V_{in}$, so for a dynamic range D the constant A is chosen as $D^{1/N}$. As the input voltage increases, the gain decreases and follows the series $$\begin{aligned} G_N &= g_m A^{N-1} \\ G_{N-1} &= g_m A^{N-2} \\ &\cdots \\ G_k &= g_m A^{k-1} \\ &\cdots \\ G_1 &= g_m. \end{aligned} \tag{1}$$

Using this knowledge of how the gain of the overall parallel-summation amplifier behaves, we can determine the gains of each path in amplifier 1200.

Each line in equation (1) corresponds to the states where N, N–1, . . . 1 paths in amplifier 1200 are contributing linearly to the output current (a path ceases to contribute linearly once its output current limits). Hence, the gains of the overall structure in (1) are broken down as $$\begin{aligned} G_1 &= G_{p1} \\ G_2 &= G_{p1} + G_{p2} \\ &\cdots \\ G_k &= G_{p1} + G_{p2} + \ldots + G_{pk} \\ &\cdots \\ G_N &= G_{p1} + G_{p2} + G_{p3} + \ldots G_{pN}. \end{aligned} \tag{2}$$

Solving (1) and (2) yields the gains of the paths through the parallel-summation amplifier 1200

$$\begin{aligned} G_{p1} &= g_m \\ G_{p2} &= g_m(A-1) \\ G_{p3} &= g_m A(A-1) \\ &\cdots \\ G_{pk} &= g_m A^{k-2}(A-1) \\ &\cdots \\ G_{pN} &= g_m A^{N-2}(A-1). \end{aligned} \tag{3}$$

Having chosen the path gains, it may now be shown that $I_{out}$ is logarithmically related to $V_{in}$. Assuming that the $k_{th}$ path in amplifier 1200 is just on the point of limiting, then the input is $$V_{in_{in}} = V_{in} = \frac{I_L}{G_{pk}} \tag{4}$$

where $I_L$ is the limiting current of the $k_{th}$ path.

However, $G_{pk}$ is known from (3) to be $G_{pk}=g_m A^{k-2}(A-1)$ for $k \geqq 2$, so that $$V_{in} = \frac{I_L}{g_m A^{k-2}(A-1)} \quad k \geq 2. \tag{5}$$

Additionally, if the $k_{th}$ path is limiting, then there are N−k paths with higher gains that are already limiting, and k−1 more paths that are still amplifying linearly. Thus, the output current is $$I_{out}=(N-k)I_L+[G_{p1}+G_{p2}+\ldots+G_{pk}]V_{in}. \tag{6}$$

Using (1) and (2), $$G_k = G_{p1} + G_{p2} + \ldots + G_{pk} = g_m A^{k-1}. \tag{7}$$

Using (5) and (7), (6) may be written as $$I_{out} = (N-k)I_L + \frac{AI_L}{A-1}. \tag{8}$$

Additionally, (5) is rewritten as $$k = \log_A\left(\frac{A^2 I_L}{V_{in} g_m (A-1)}\right). \tag{9}$$

Finally, substituting (9) into (8) gives $$I_{out} = I_L\left(N + \frac{A}{A-1} + \log_A\left(\frac{V_{in} g_m (A-1)}{A^2 I_L}\right)\right) \tag{10}$$

which is the desired logarithmic relationship between $I_{out}$ and $V_{in}$.

There is one final consideration regarding the case of k=1, not considered in (5), which is the case where the lowest gain path limits. When path $G_{p2}$, whose gain is $G_{p2}=g_m(A-1)$, limits and provides a current of $I_L$, the input voltage is $$V_{in} = \frac{I_L}{G_{p2}} = \frac{I_L}{g_m(A-1)}. \tag{11}$$

At this input voltage, the current provided by the lowest gain path is $$I = g_m V_{in} = \frac{g_m I_L}{g_m(A-1)} = \frac{I_L}{A-1}. \tag{12}$$

This point occurs at the total system output current of $(N-1)I_L+C$ in FIG. 13, and in order for the logarithmic slope of the output to continue, the lowest gain path must provide another $I_L$ of current before it limits. Adding this to (12) gives $$I_{LI} = \frac{I_L}{A-1} + I_L = \frac{A}{A-1} I_L, \tag{13}$$

which represents the limiting current level of the lowest gain path. Thus, the lowest gain path provides a maximum current that is A/(A−1) times higher than the other paths.

Figure 14:
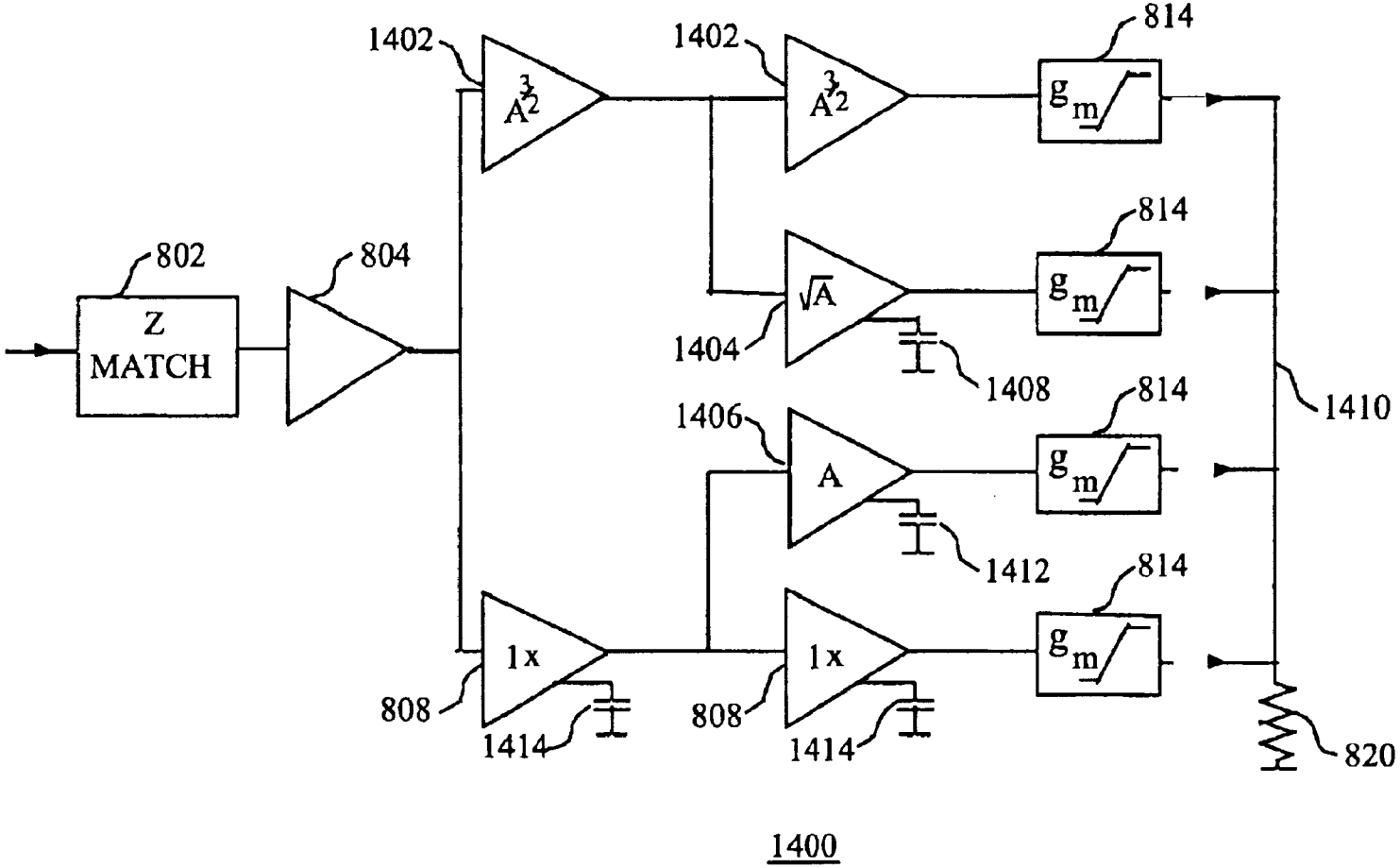
FIG. 14 is a simplified block diagram of an alternate two-stage preferred embodiment.

Having derived the ideal path gains for a parallel-summation logarithmic amplifier, some useful variations from the ideal are now described. FIG. 14 shows an alternate preferred embodiment of the present invention that uses path gains of 1 (using buffer amplifiers 808), A (using the first of the buffer amplifiers 808 and amplifier 1406), $A^2$ (using the first amplifiers 1402 and amplifier 1404), and $A^3$ (using amplifiers 1402) all summed on current bus 1410. Capacitors 1408, 1412, and 1414 are used to equalize the path delays. Using these path gains has the advantage of simplicity, although the cusps of the logarithmic approximation in FIG. 4 will no longer lie on a logarithmic Line but merely close to one. Furthermore, it should be noted that if the path gains were chosen to follow the 1, $A^2$, $A^3$, . . . $A^N$ pattern, then some of the component amplifiers within the intermediate gain paths in FIGS. 9 and 10 would branch at different points.

Also included in the embodiment of the present invention in FIG. 14 is that the limiters at the output of each path are the same. Such a choice has the advantage of simplicity, although leads to a somewhat less accurate response.

Figure 15:
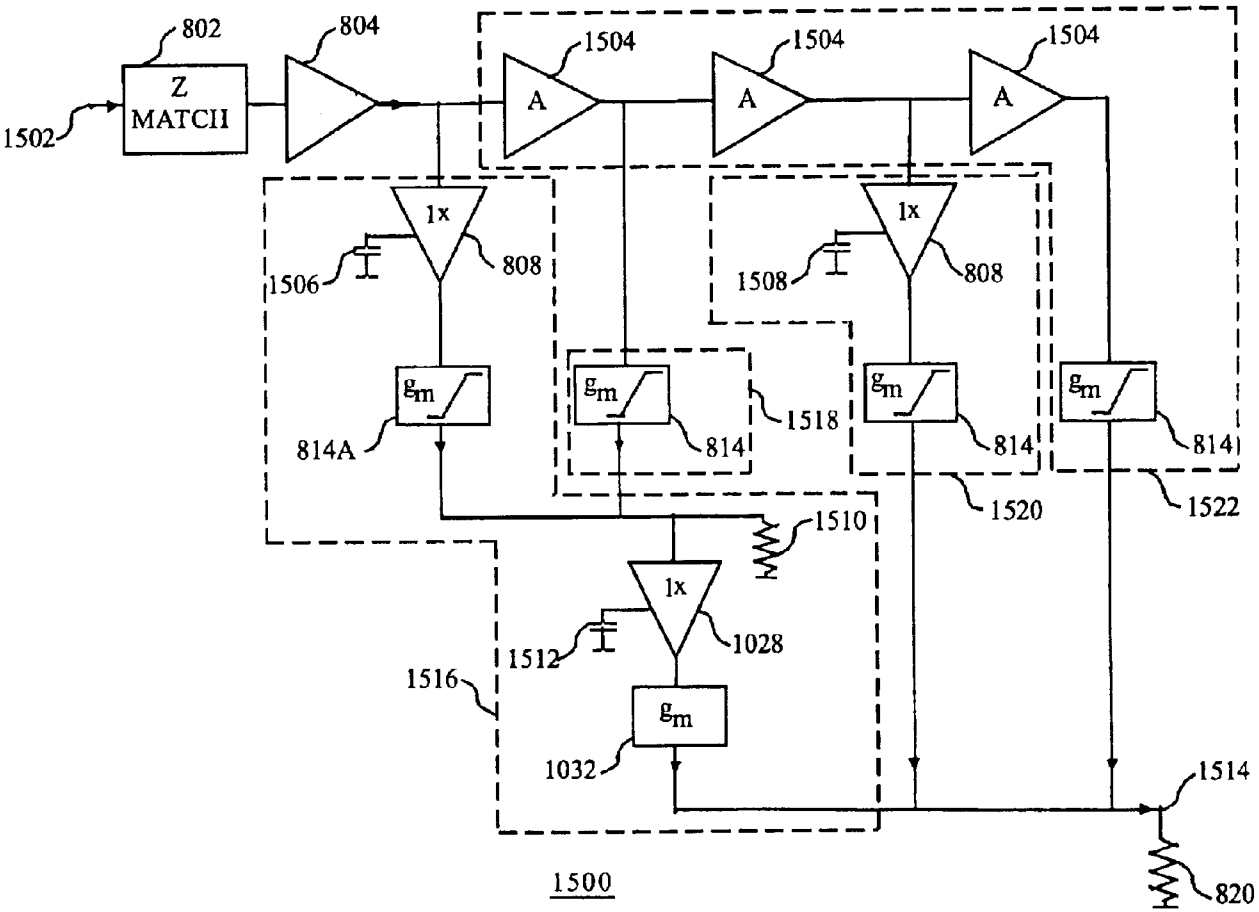
FIG. 15 shows the proposed delay amplifier used in a novel progressive-compression structure.

The delay amplifiers presented so far, which use capacitive elements to set their & delay, may be used in the novel configuration 1500 shown in FIG. 15 to improve the internal delay matching of the progressive-compression amplifier. In amplifier 1500, the highest gain path is formed from elements in 1522 comprising three series connected amplifiers 1504 with limiter 814, and the next to highest gain path is formed from the first two amplifiers 1504 in 1522 and elements 1520 comprising delay amplifier 808 (capacitatively loaded by capacitor 1508) with limiter 814. Delay amplifiers 808, capacitatively loaded at 1506 and 1508, are added to some paths in the amplifier so that the phasing and group delay through each path is the same. However, rather than delaying all paths separately, the signals in the two lowest gain paths comprising 1518 and elements 1028 and 1032 in 1516. and elements in 1516 are limited by elements 814A and 814, respectively, and then summed across resistor 1510. The combined signal across resistor 1510 is then delayed through a single path consisting of delay amplifier 1028, capacitatively loaded at 1512, and transconductance element 1032 before being added to the signals from the higher gain paths to form the output signal 1514. The output signal 1514 will be logarithmically related to the input signal 1502. Combining the delay paths reduces the amount of delay hardware needed compared to the case where the paths are delayed separately.

Figure 16:
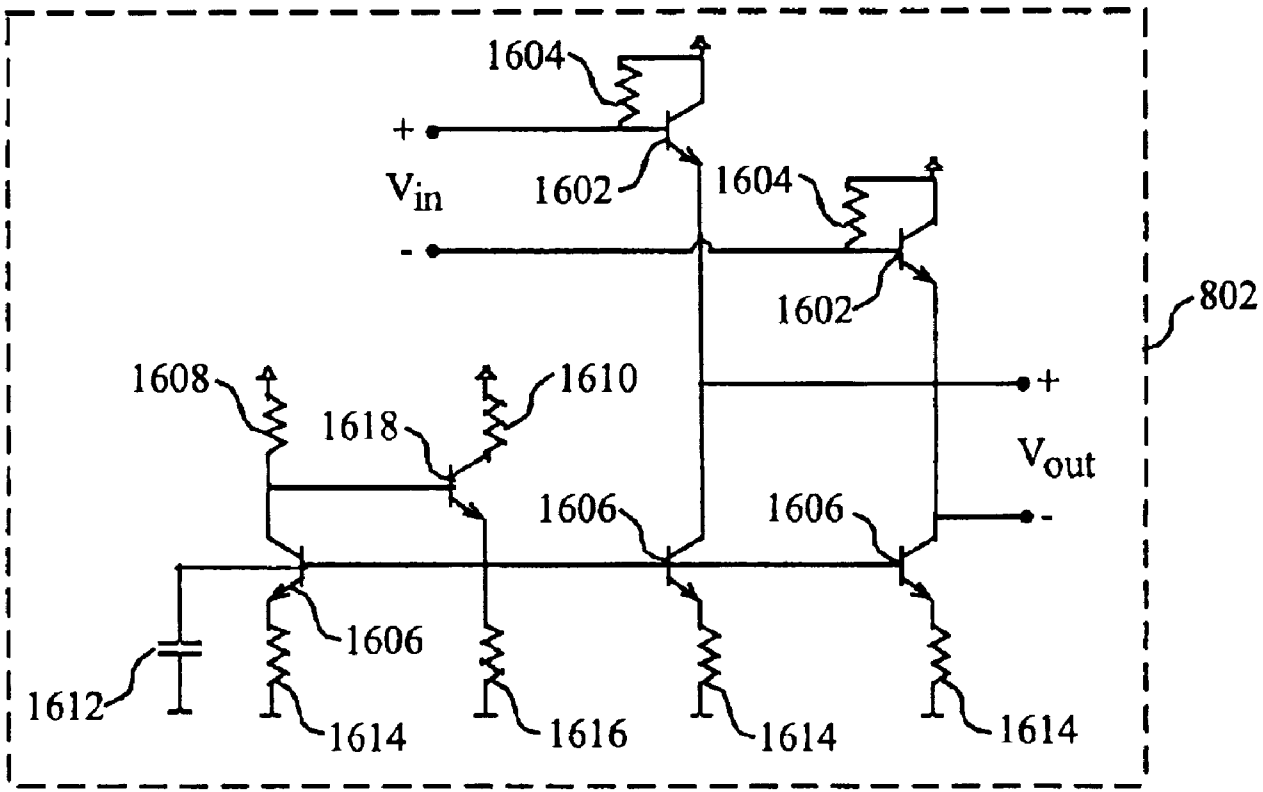
FIG. 16 is a schematic of the input impedance matching circuit.

Having shown the block diagrams of the present invention, the schematic diagrams of the components of the preferred embodiments are now described. FIG. 16 is the schematic diagram of the impedance matching circuit 802. Bipolar transistors 1602 are arranged in emitter-follower configuration, with 50 Ohm resistors 1604 connected from base to collector. Transistors 1606 and 1618 and resistors 1608, 1610, 1614, and 1616 form a current source that supplies power to the emitter followers. Capacitor 1612 is useful for reducing the output noise of this circuit. The circuit in FIG. 16 will be one of the most important circuits in the logarithmic amplifier in terms of noise performance. For this reason, transistors 1602 should be made relatively large in order to minimize the thermal noise from their parasitic base resistance. The designer should also monitor the amount of shot noise contributed by the collector current of transistors 1602, and try to minimize this noise either with the help of CAD design tools or using low noise circuit design techniques.

Figure 17:
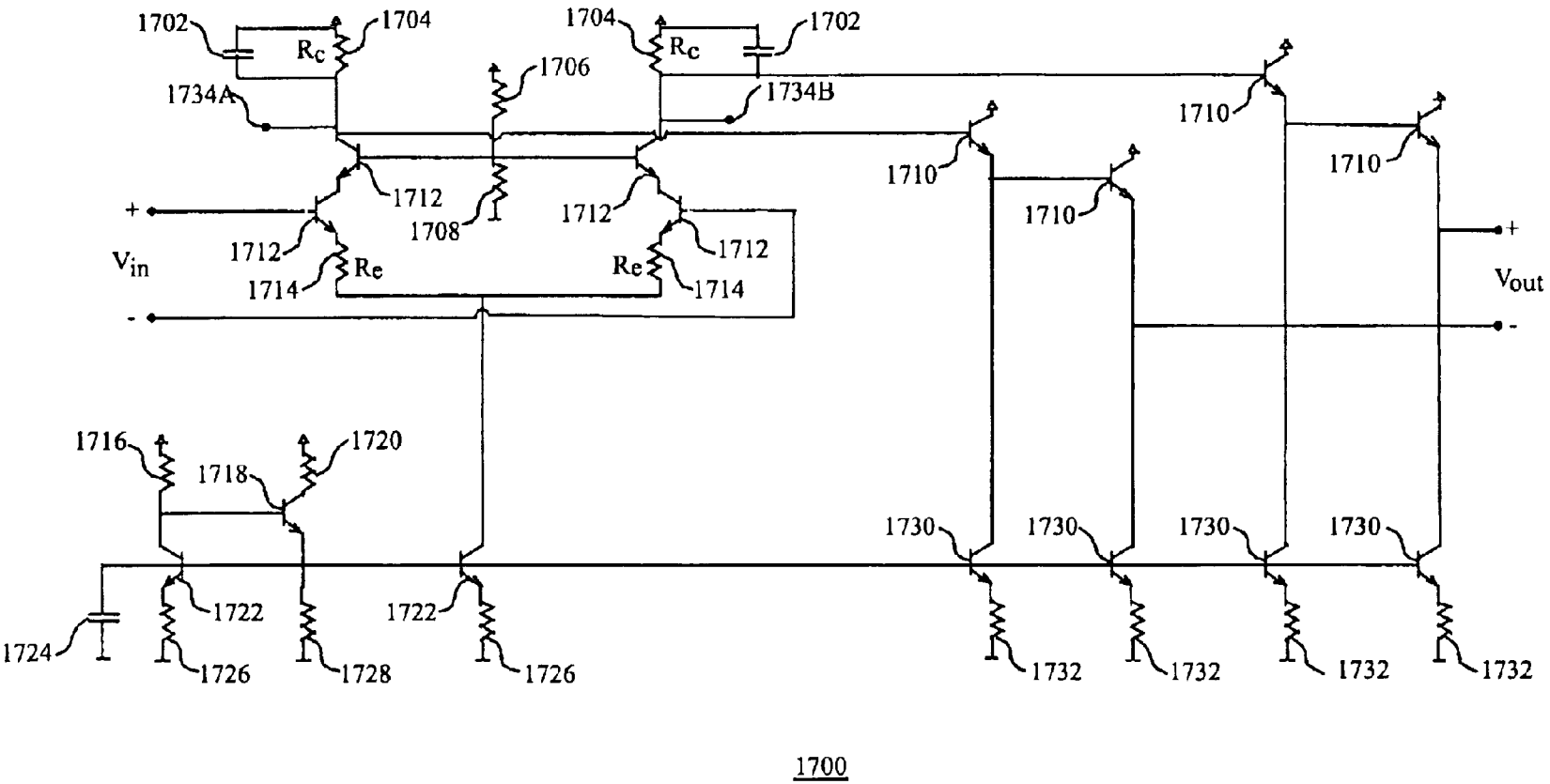
FIG. 17 is a schematic of an amplifier.

FIG. 17 is a schematic diagram of the amplifiers used for both amplification and delay. The four transistors 1712 may be used to amplify the signal, with the gain given approximately by $$\frac{V_{out}}{V_{in}} \cong \frac{g_m R_c}{(1 + g_m R_e)} \tag{14}$$

where gm is the transconductance of the transistors 1712. If a gain of less than one is desired, then this may be accomplished by making Re (1714) larger than Rc (1704) or by using a low bias current. Resistors 1706, 1708, 1716, 1720, and 1728 and transistors 1718, 1722, and 1730 are used to help bias amplifier 1700. Resistors 1726 and 1732 and capacitor 1724 are useful for reducing the output noise of this circuit. Capacitors 1702 may be used for increasing the group delay and phase shift of amplifier 1700. Antiphase signals at nodes 1734A and 1734B pass through transistors 1710 in order to reduce the DC voltage level of the output signal to a convenient level. The shape of the transfer function of this amplifier is a hyperbolic tangent, the same as the dotted line 1104 in FIG. 11 except that here the output variable is voltage, not current.

If amplifier 1700 is used as the first high gain amplifier at the input of the logarithmic amplifier, such as amplifier 804 or 806 in FIG. 8, then it will be a very important circuit in terms of the noise performance of the logarithmic amplifier. In this case, resistors 1714 should be omitted, as they will contribute significant thermal noise. Furthermore, transistors 1712 should be made relatively large in order to minimize thermal noise arising from their parasitic base resistance.

Figure 18:
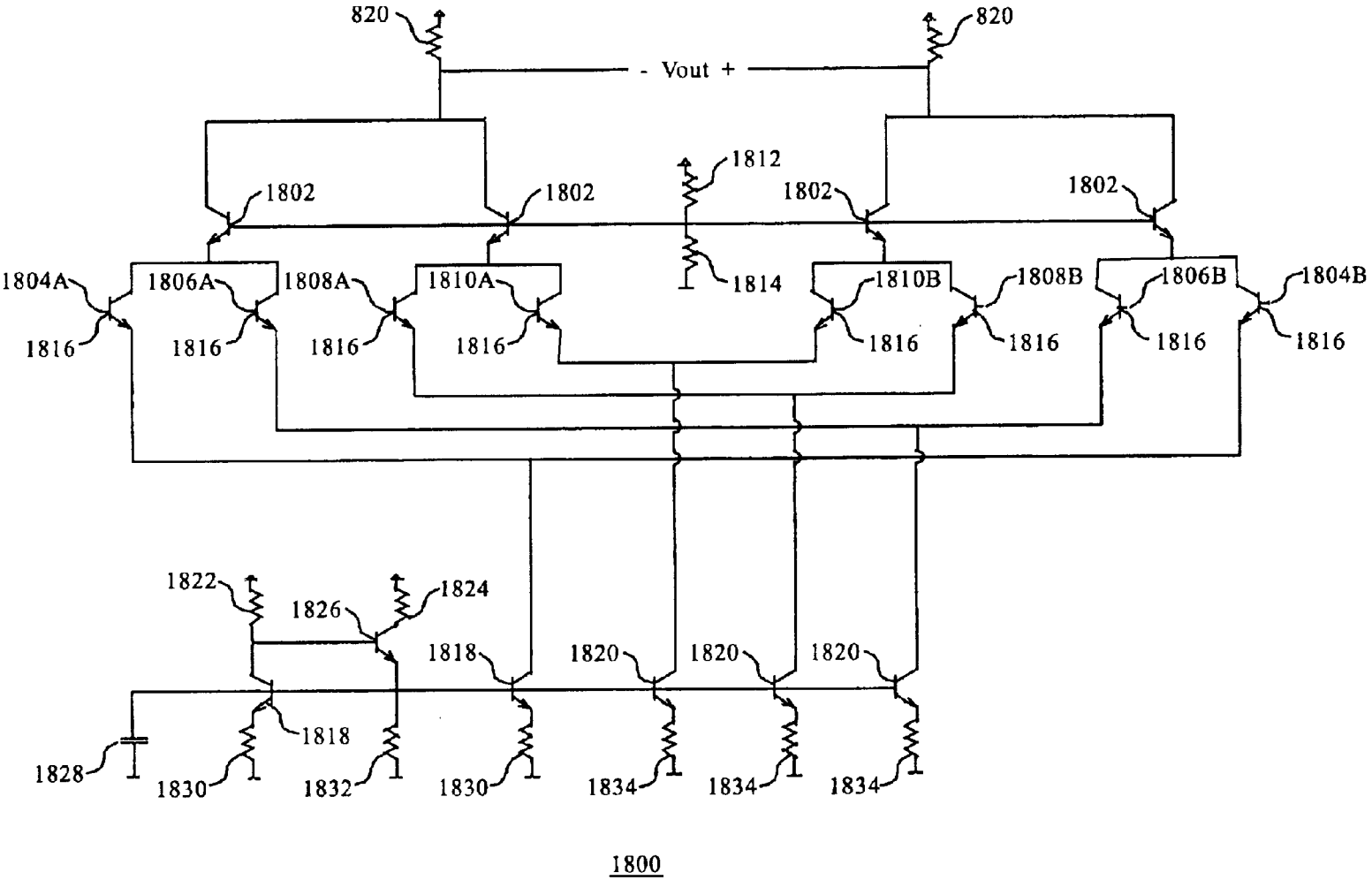
FIG. 18 is a schematic of the summer/limiter circuit.

FIG. 18 shows a four-stage summing and limiting circuit. This circuit implements, from FIG. 8, three limiters 814, one limiter 814A, current bus 818, and termination element 820. Element 820 at the top of the schematic is chosen as 50 Ohms to allow for efficient connection to microwave systems. There are four pairs of transistors 1816, and each pair accepts one differential input signal, for example between 1804A and 1804B. When the input signal applied to a pair of transistors 1816 swings positive and negative, the constant current supplied to that transistor pair from transistors 1818 or 1820 is steered from one side of the pair to the other. However, for large input signals, all of the available current shifts to the side with the highest positive applied voltage. When all of the available current flows through one side of a pair of transistors 1816, the current is said to be limited. This provides the limiting action required at the output of each path in the logarithmic amplifier. The pair of transistors 1816 that accept the inputs 1804A and B comprises the lowest gain path and is biased with a higher constant current by transistor 1818 than the other pairs, which are supplied by transistors 1820. This means that this part of the summer has a higher limiting value and a higher gain than what is used for the other three input pairs composed of inputs 1806–1810. The higher gain will raise the gain of the lowest gain path above unity, however the gain of the buffer amplifiers in this path may be lowered to compensate. All of the currents flowing through transistors 1816 flow through isolation transistors 1802 and through output resistances 820. The voltages across resistances 820 form the complementary output voltage pair, which will be logarithmically related to the input of the overall logarithmic amplifier if the gains of the paths are chosen appropriately. Resistors 1812, 1814, 1822, 1824, 1832 and transistor 1826 are used to help bias amplifier 1800. Resistors 1830 and 1834 and capacitor 1828 are used to reduce the output noise of amplifier 1800.

It should be cautioned that when DC-coupled amplifiers are used, the gain of amplifier 1800 should not be made too large. This is because a high-gain summing circuit will only further amplify DC offset errors. For this reason, it may be desirable in some cases to use the well know technique of resistive emitter degeneration to lower the summer gain, which involves placing resistors in series with the emitter leads of transistors 1816. However, the gain of the summing amplifier should also not be made too low, or a larger signal will be required in order to steer all of the branch currents to-one side of the amplifier.

Figure 19:
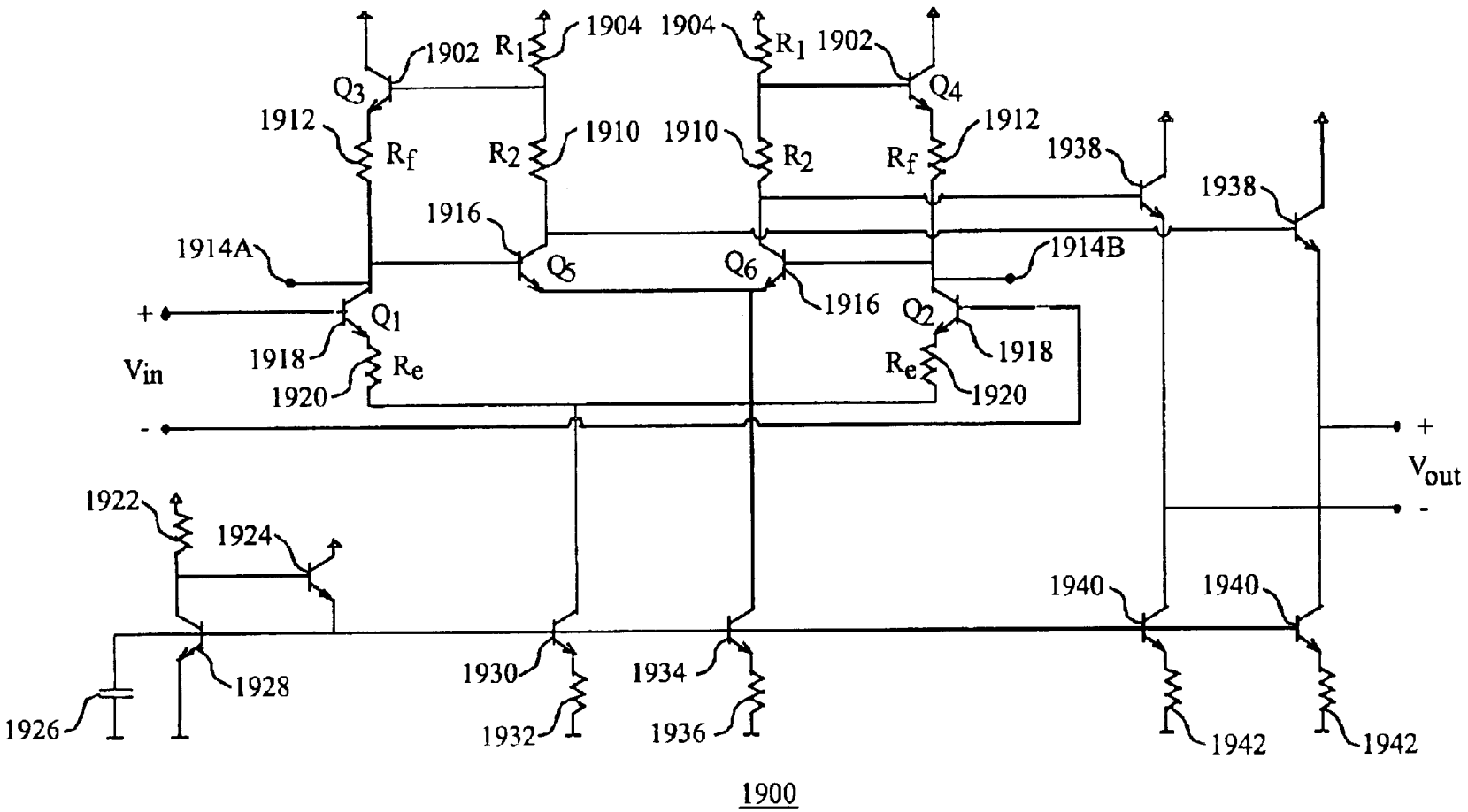
FIG. 19 is a schematic diagram of a parallel feedback amplifier.

FIG. 19 shows an alternate circuit 1900 that may be used for both amplification and delay in place of amplifier 1700. This circuit is a parallel feedback amplifier (PFA), and it is described in Y. M. Greshishchev and P. Schvan, "A 60-dB Gain, 55-dB Dynamic Range, 10-Gb/s Broad-Band SiGe HBT Limiting Amplifier", IEEE Journal of Solid State Circuits, volume 34, number 12, pp. 1914–1920, December 1999. What is novel here is the use of a PFA in a piecewise-approximate logarithmic amplifier. The PFA is a useful building block not only for its high bandwidth, but also because of its superior delay characteristics.

The low frequency gain of amplifier 1900 is approximately given by $$\frac{V_{out}}{V_{in}} = G \cong \frac{g_{m1}(R_f + r_{d1})(R_1 + R_2)}{(1 + g_{m1}R_e)(R_1 + r_{d5})} \tag{15}$$

where gm1 is the transconductance of transistors Q1 and Q2 (1918) and Q3 and Q4 (1902); rd1 is equal to 1/gm1, and similarly rd5 is the inverse of the transconductance of transistors Q5 and Q6. By adjusting the relative value of resistors 1904 and 1910 in relation to the values of resistors 1912, amplifiers of significantly different gains but of similar delay characteristics may be realized. This is extremely advantageous, because this means that delay capacitors 1702 are not required when the PFA is used as the logarithmic amplifier building block. However, when amplifier 1900 is used only for delay, emitter degeneration resistors 1920 may be useful for lowering the gain. If resistors 1920 are not used, resistors 1912 and 1932 should be made from the same material so that the effect of their changes with temperature and process on the amplifier gain cancel. Resistors 1936 and 1942 and capacitor 1926 are used to help reduce the output noise of this circuit. Transistors 1938 and 1940 form an emitter follower impedance conversion stage.

Amplifier 1900 has some other important features to allow for stable operation despite variations in manufacturing and temperature. Transistors 1924, 1928, 1930, and 1934 form a DC current source. This scheme may be used in place of the biasing schemes shown in FIGS. 16, 17, and 18. The collector current of transistors 1930 and 1934 increases with increasing temperature and so is PTAT (proportional to absolute temperature). If transistors 1930 and 1934 are made much larger than transistor 1928, then the collector current of transistors 1930 and 1934 will increase more steeply with increasing temperature. As a separate effect, the transconductances of transistors 1918 and 1916 decrease with increasing temperature. These effects will roughly cancel each other in amplifier 1900, creating an overall amplifier whose gain is substantially independent of temperature.

Unfortunately, the value of resistor 1922 will vary with process variations. In implementations where increased precision is required, it will be necessary to replace the DC current source that is shown with a current source that uses a bandgap reference voltage circuit. A description of these circuits may be found in textbooks on circuit design, such as Gray et al, "Analysis and Design of Analog Integrated Circuits", fourth edition, John Wiley & Sons Inc., 2001.

Figure 20:
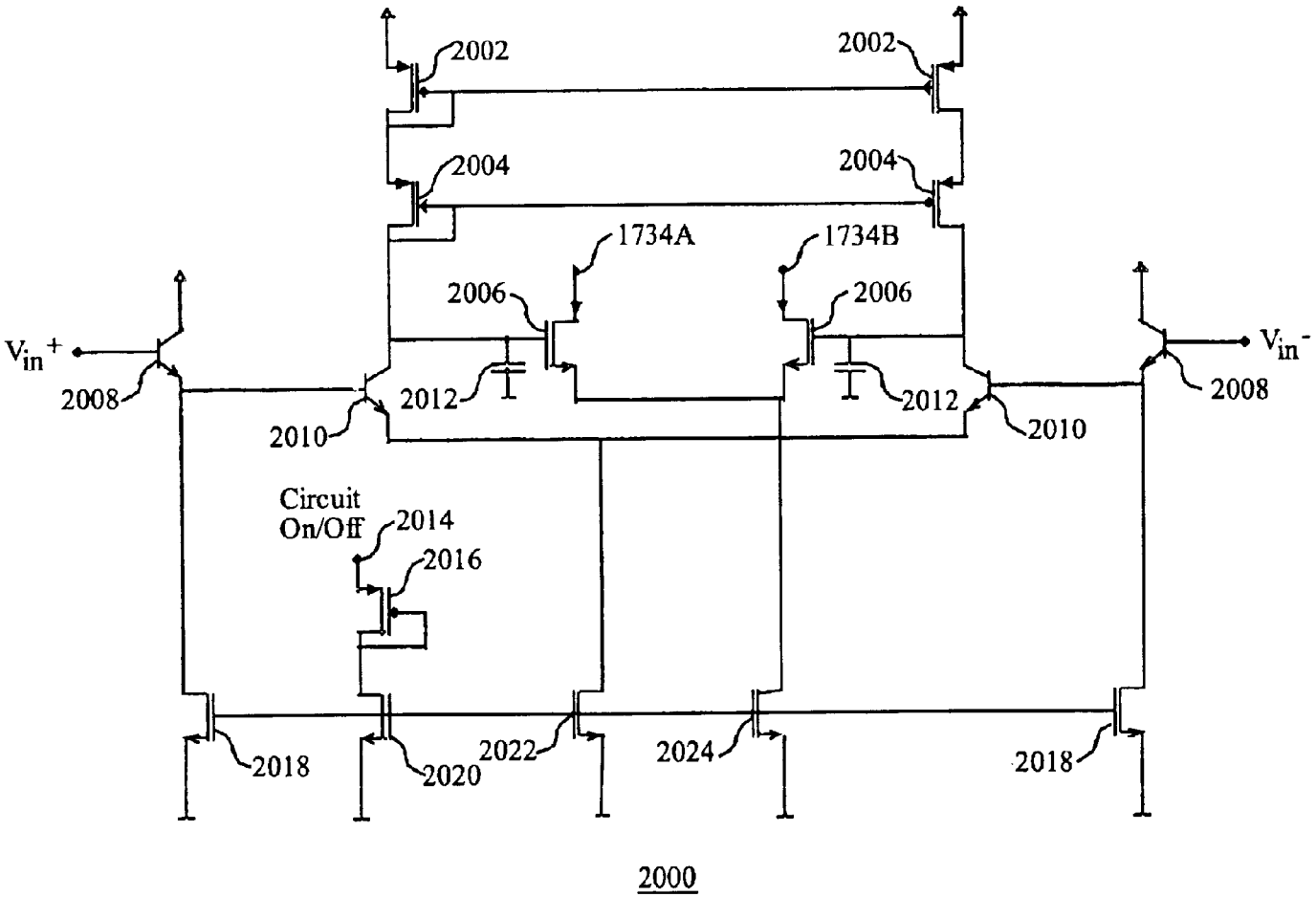
FIG. 20 is a schematic of a preferred embodiment of an amplifier to be used as negative feedback to reduce DC offsets.

The design issue of controlling DC offset errors was raised in discussing the summing circuit 1800. Offset voltages in DC coupled logarithmic amplifiers must be minimized through careful design since they may unbalance the amplifier and reduce the available signal range. FIG. 20 shows one DC offset reduction scheme that is amenable to fabrication in integrated circuit form. If amplifier 2000 is made to have a very high gain and small bandwidth compared to amplifier 1700 or 1900, and if it is connected in negative feedback around amplifier 1700 or 1900, then the effect will be to greatly reduce the DC offsets in the logarithmic amplifier. If amplifier 2000 is connected in negative feedback around amplifier 1700 or 1900, then Vout+ and Vout− in amplifier 1700 or 1900 should connect to terminals Vin+ and Vin− in amplifier 2000 respectively. As well, terminals 1734A and 1734B in amplifier 2000 would connect to terminals 1734A and 1734B in amplifier 1700, or to terminals 1914A and 1914B in amplifier 1900. This scheme will not eliminate the DC offsets entirely, because amplifier 2000 will have its own DC offset associated with it. Still, it will reduce the output referred DC offset of amplifier 1700 or 1900 to the approximate level of the input referred DC offset of amplifier 2000. If the impedance at the collector node of transistor 2010 is high, then the designer can use only modest values for capacitors 2012 to make the bandwidth of amplifier 2000 much less than that of amplifiers 1700 and 1900 so that the negative feedback does not cancel significant portions of useful bandwidth. Furthermore, the drain currents of MOSFET transistors 2006 can be relatively small, so that amplifier 2000 does not change the operating points of amplifiers 1700 or 1900 when it is connected to them. Furthermore, the entire feedback circuit can be easily switched on or off by connecting point 2014 to the circuit's positive or negative voltage supply respectively. Transistors 2002 and 2004 form the high impedance active load of amplifier 2000. Transistors 2008 form a voltage level shifting circuit and transistors 2016, 2018, 2020, 2022, and 2024 are used to supply power to amplifier 2000.

Figure 5:
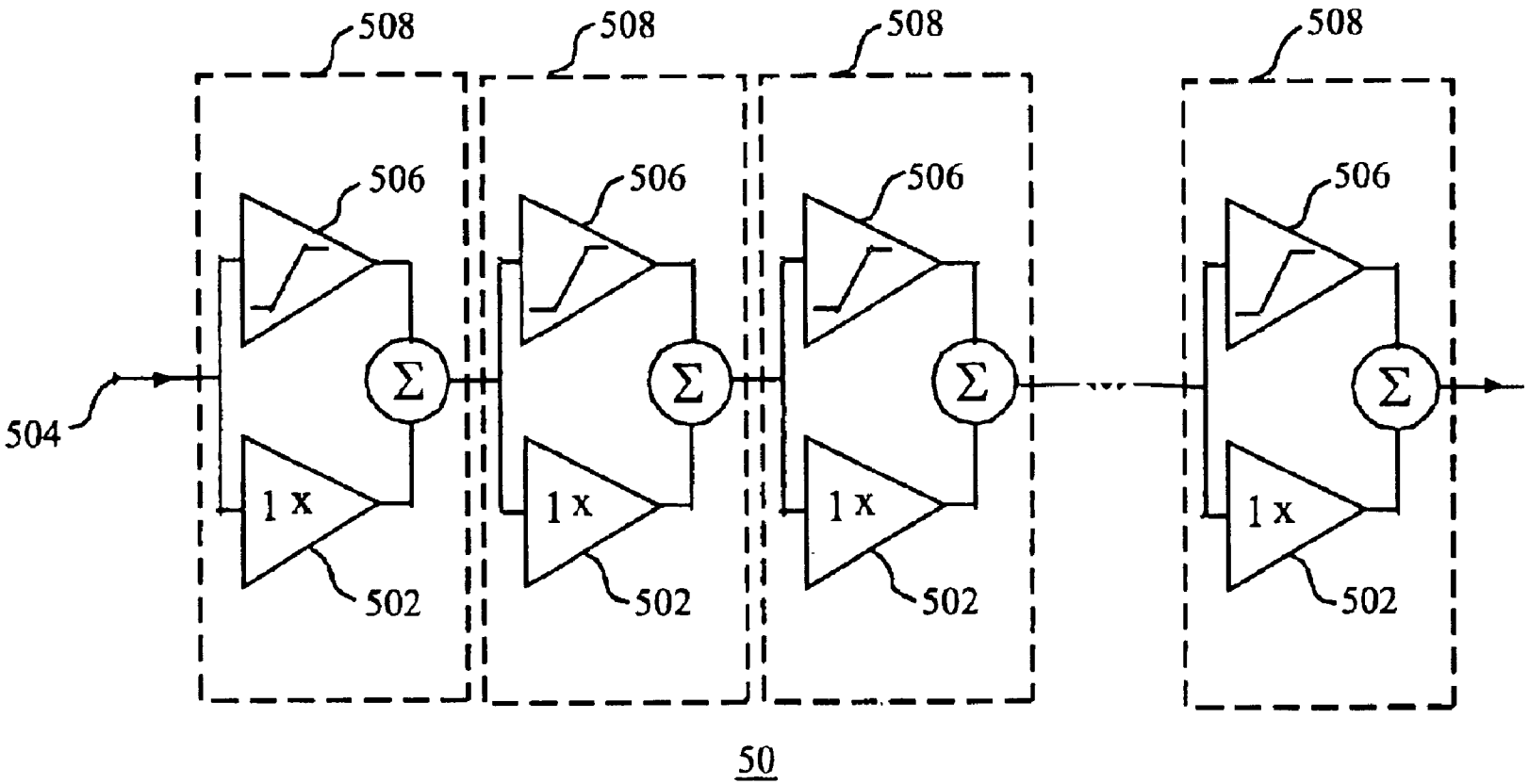
Figure 5 PRIOR ART
FIG. 5 is a block diagram of a twin-gain stage logarithmic amplifier.
Figure 21:
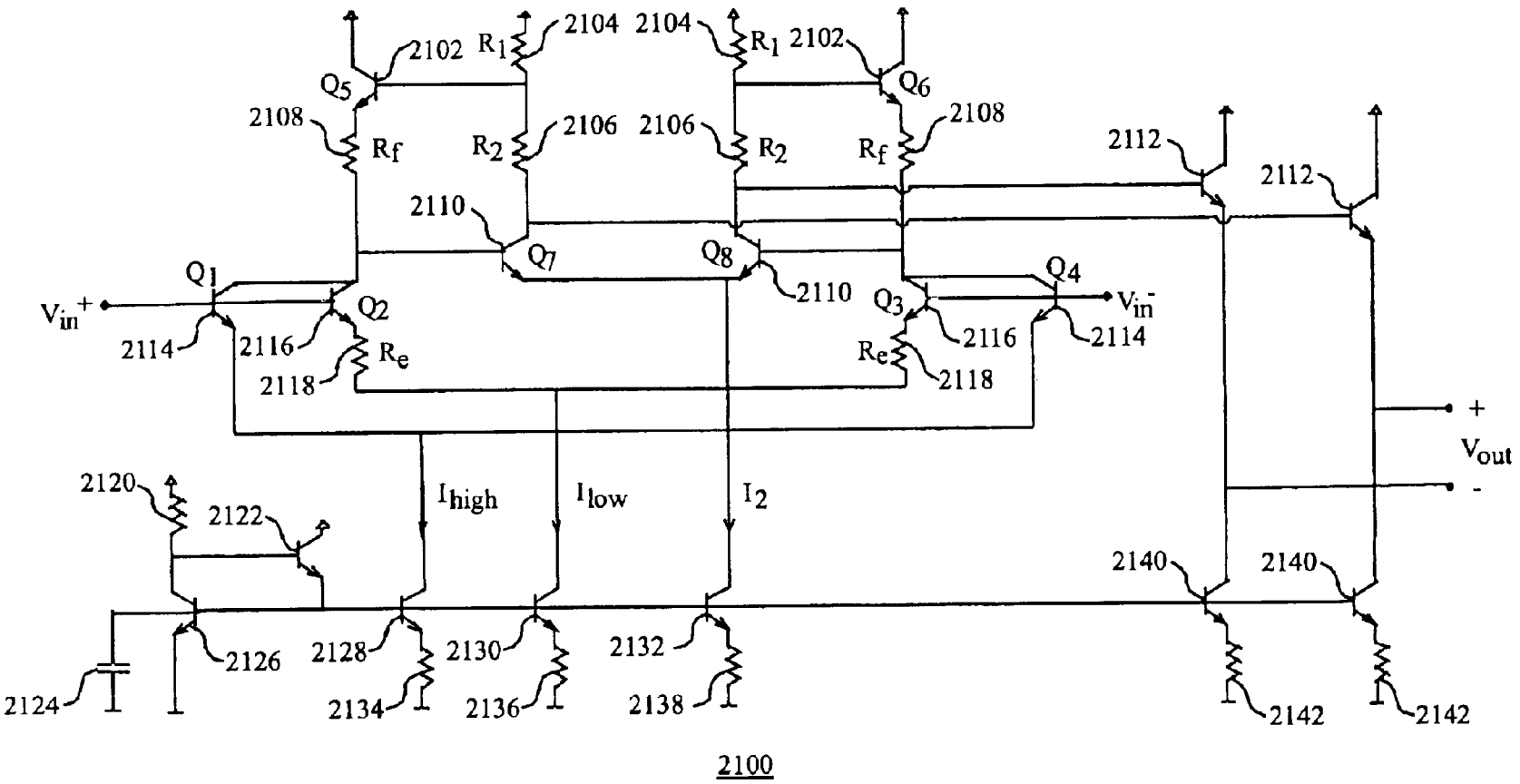
FIG. 21 is a schematic of one twin-gain stage parallel feedback amplifier embodiment.

So far, this detailed description has dealt with parallel summation logarithmic amplifiers. However, the idea of using amplifiers with feedback in a piecewise approximate logarithmic amplifier may be extended to the series linear-limit logarithmic amplifier in FIG. 5. If this were done, one of the twin gain stages in FIG. 6 would become amplifier 2100 shown in FIG. 21. Amplifier 2100 contains two gain paths; a high gain path containing transistors 2114 and a low gain path containing transistors 2116 and resistors Re (2118). Resistors R1 (2104), R2 (2106), and Rf (2108) are common to both paths. The gain of the high gain path is approximately given by $$G_{high} \cong \frac{g_{m1}(R_f + r_{d5})(R_1 + R_2)}{(R_1 + r_{d7})} \tag{16}$$

where gm1 is the transconductance of transistors Q1 and Q4, gm5 is the transconductance of transistors Q5 and Q6 (2102), rd5 is equal to 1/gm5, and similarly rd7 is the inverse of the transconductance of transistors Q7 and Q8 (2110). Using the same notation, the gain of the low gain path is approximately given by $$G_{low} \cong \frac{g_{m2}(R_f + r_{d5})(R_1 + R_2)}{(1 + g_{m2}R_e)(R_1 + r_{d7})}. \tag{17}$$

Using these equations, the component values in amplifier 2100 may be chosen to set $G_{low}$ to a low gain, unity for instance, and $G_{high}$ to the desired value. Furthermore, for a given $I_{high}$ in FIG. 21, $I_{low}$ should be made at least equal to $NI_{high}$ where N is the number of twin-gain stages to be cascaded. Satisfying this condition ensures that the low gain path will not saturate prematurely. Another necessary condition to ensure that the low gain path does not saturate too easily is that 12 should be made sufficiently large. The requirement on $I_2$ may be expressed by using the fact that the gain from the collector of Q2 to the collector of Q7 is gm7(R1+R2). As well, the limiting value at the output of one side of the twin-gain stage is $I_2$(R1+R2). Using these values, the requirement on $I_2$ becomes $$I_2 \geqq I_{low}(R_1 + r_{d5})g_{m7} \tag{18}$$

Figure 6:
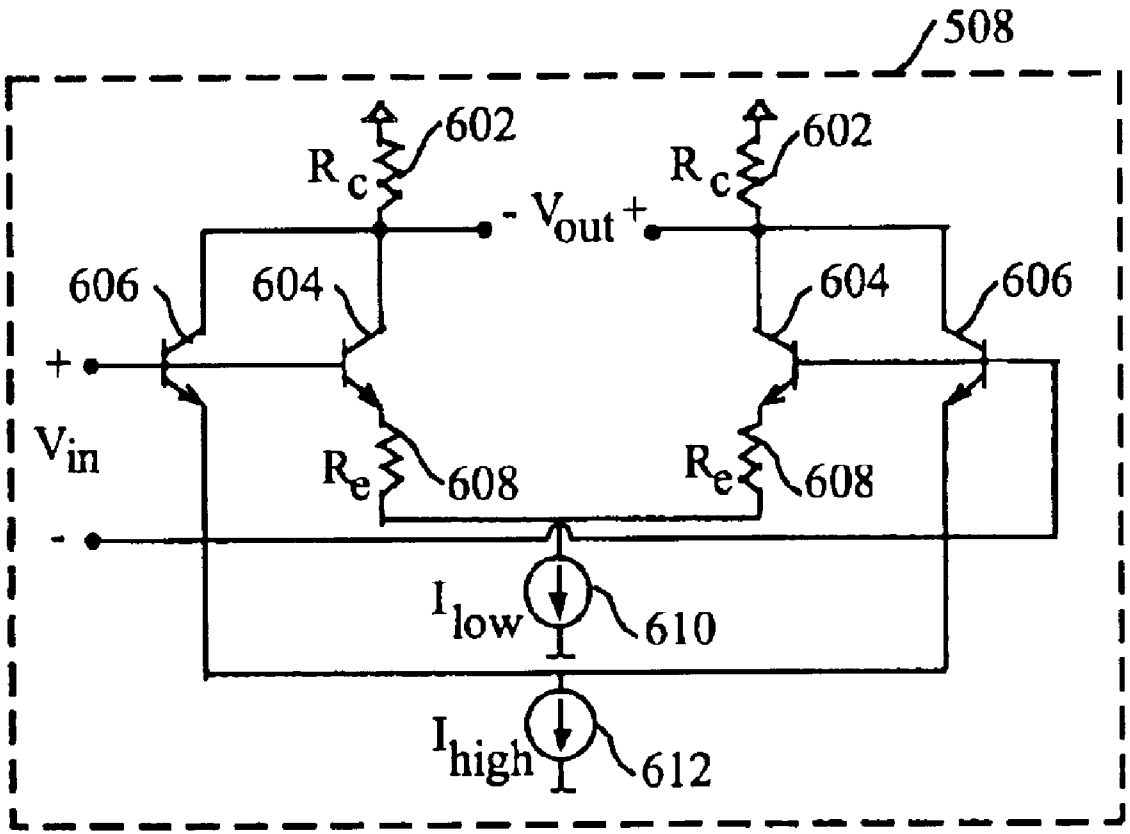
Figure 6 PRIOR ART
FIG. 6 is a schematic diagram of one twin-gain stage.
Figure 7:
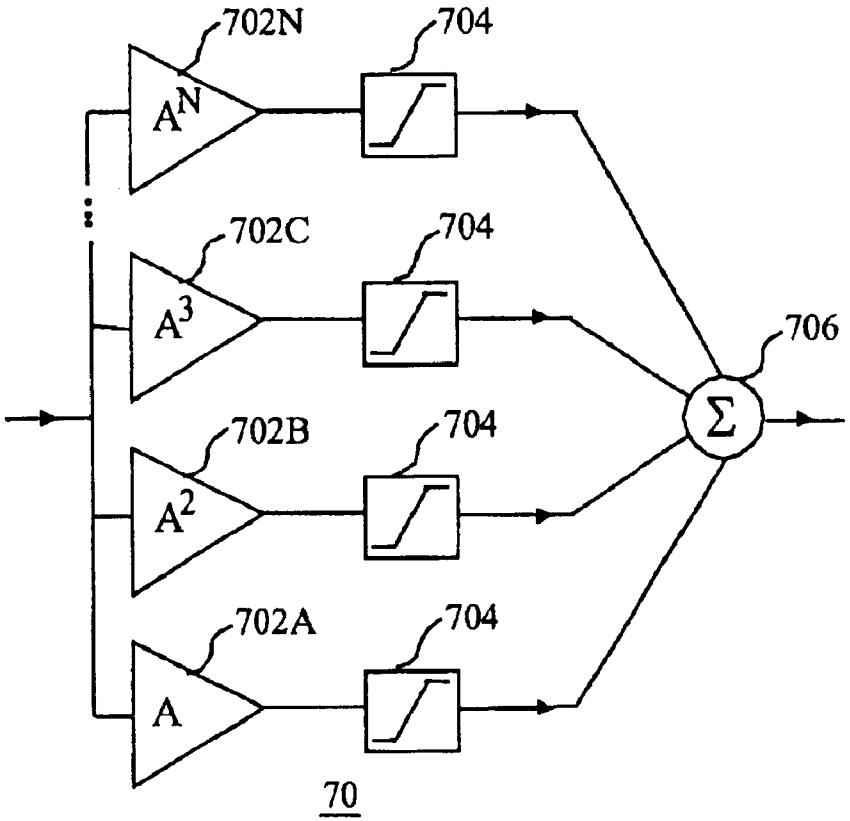
Figure 7 PRIOR ART
FIG. 7 is a block diagram of a parallel logarithmic converter.

Hence, by careful design, amplifier 2100 may be designed to have a high and a low gain path, similar to the traditional twin-gain stage in FIG. 6. However, the amplifier 2100 can be made to have a significantly higher bandwidth due to the introduction of the parallel feedback technique. Resistors 2120, 2134, 2136, 2138, and transistors 2122, 2126, 2128, 2130, and 2132 form a PTAT current supply circuit. Transistors 2112 and 2140 form an emitter follower impedance conversion stage. Resistors 2142 and capacitor 2124 are useful for lowering the output noise of amplifier 2100.

Figure 1:
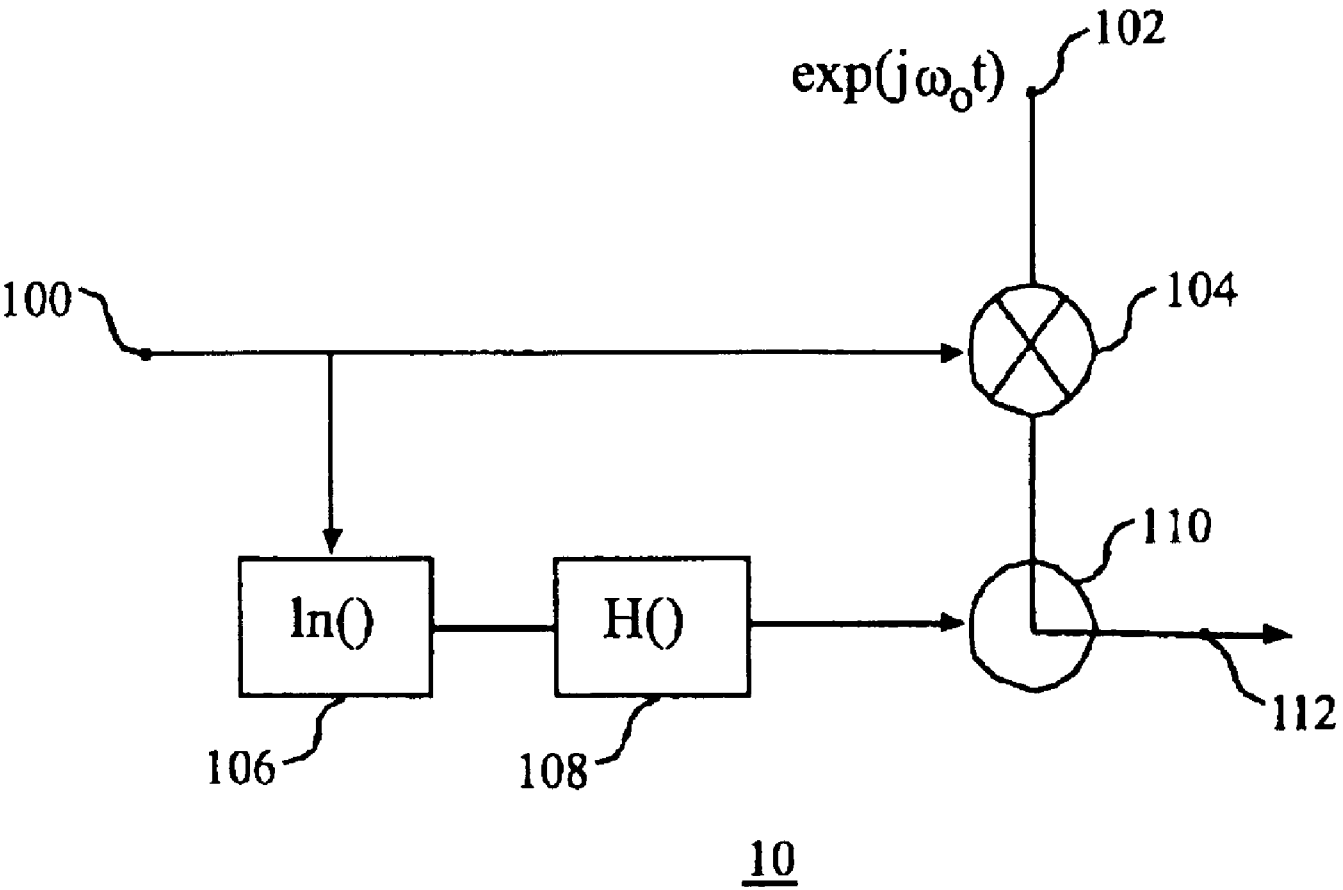
Figure 1 PRIOR ART
FIG. 1 is a block diagram of an optical modulation system.
Figure 2:
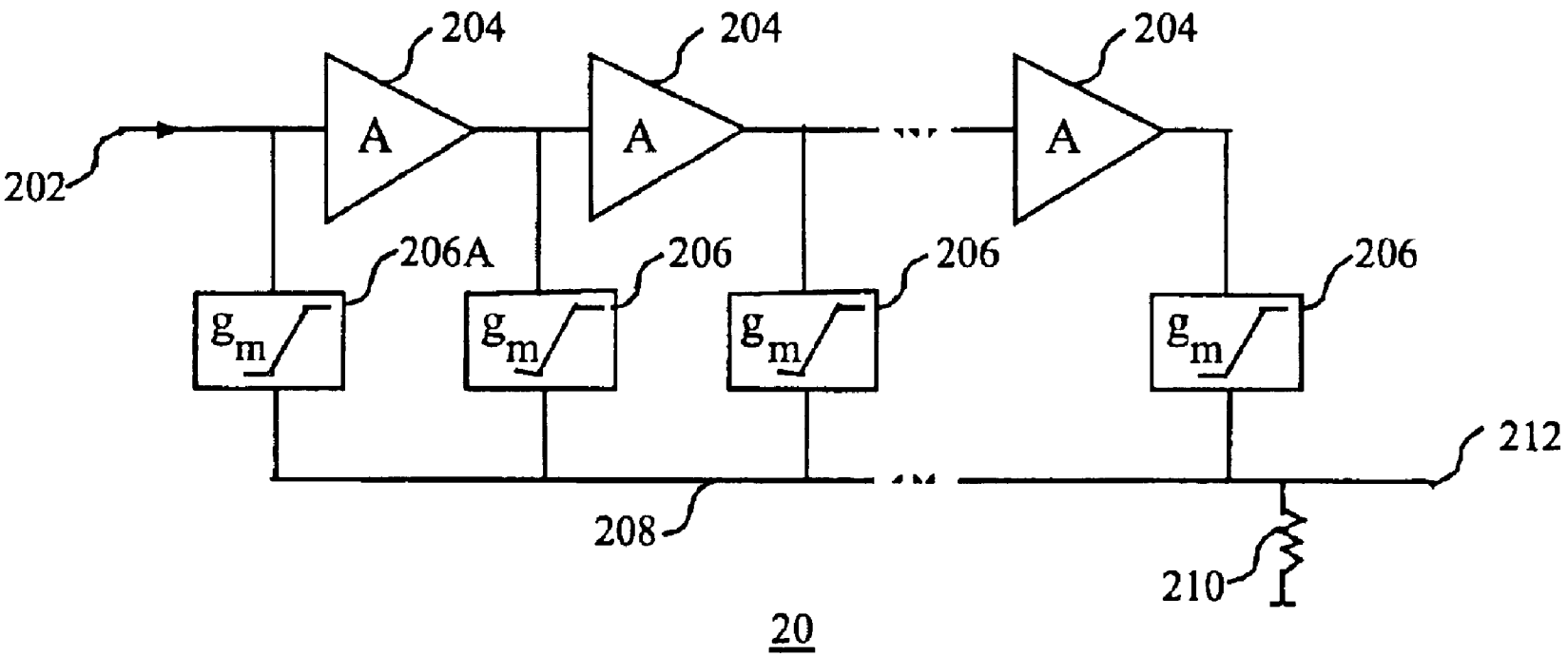
Figure 2 PRIOR ART
FIG. 2 is a block diagram of a progressive-compression amplifier.
Figure 3:
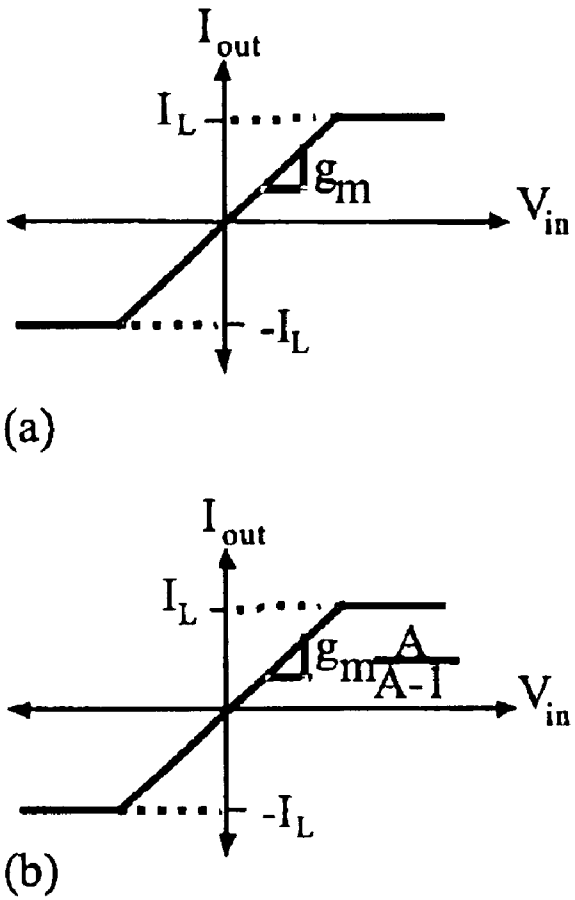
FIG. 3 shows limiting transconductance element responses.

The amplifiers disclosed in this patent are suitable for use in the single-sideband optical modulator shown in FIG. 1. DC level shifters, delay elements and linear amplification components may be necessary both before and after the logarithmic amplifier in order for the logarithmic amplifier to interface correctly with the Hilbert transformer 108 and the input signal 100.

A person skilled in the art could make immaterial modifications to the invention described in this patent document without departing from the essence of the invention that is intended to be covered by the scope of the claims that follow.

What is claimed is:

1. A logarithmic amplifier receiving an input voltage, comprising:

a high gain section having plural gain paths, each gain path including an amplifier and a signal limiter in series, and each gain path being connected to a common input such that the paths are in parallel, each of the gain paths having an output and a gain;

the outputs of the plural gain paths being connected to a signal summation circuit and summed to form an output signal;

a low gain section connected between the common input and the signal summation circuit;

delay elements in plural gain paths of the high gain section and the low gain section, the delays of the delay elements being selected to compensate for variation between group and phase delay of the plural gain paths, the delay elements of at least two of the plural gain paths of the high gain section sharing a common amplifier such that signals in the at least two of the plural gain paths are amplified by the common amplifier; and the gain of each of the low gain section and the plural gain paths of the high gain section being selected so that the output signal varies logarithmically with the input voltage.

2.The logarithmic amplifier of claim 1 in which each delay element comprises a buffer amplifier.

3. The logarithmic amplifier of claim 2 in which each buffer amplifier is connected to a capacitor for delay compensation.

4. The logarithmic amplifier of claim 1 in which the highest gain path in the high gain section comprises at least two series connected amplifiers.

5. The logarithmic amplifier of claim 4 in which the highest gain path in the high gain section shares an amplifier with the next highest gain path in the high gain section such that signals in the highest gain path in the high gain section and the next highest gain path in the high gain section are amplified by a common amplifier.

6. The logarithmic amplifier of claim 1 in which each gain path in the high gain section shares an amplifier with another gain path in the high gain section such that signals in the each gain path in the high gain section and the another gain path in the high gain section are amplified by a common amplifier.

7. The logarithmic amplifier of claim 1 further comprising an amplifier on the common input to the high gain section and low gain section.

8. The logarithmic amplifier of claim 1 in which the gain paths share amplifiers such that signals in the gain paths are amplified by common amplifiers and such that the number of gain paths in the logarithmic amplifier exceeds the number of amplifiers in the highest gain path of the high gain section by at least two.

9. The logarithmic amplifier of claim 1 in which the gains of the gain paths are selected such that the ratio of succeeding gains in the gain paths is a function of A-1 where A is equal to $D^{1/N}$, D is the dynamic range of the logarithmic amplifier and N is the number of gain paths in the logarithmic amplifier.

10. The logarithmic amplifier of claim 1 in which the common input is connected to a source of an information signal.

11. The logarithmic amplifier of claim 10 in combination with a series connected Hubert transformer to produce a control signal that is output to a phase modulator and combined with an envelope signal to produce a single sideband signal.

12. The logarithmic amplifier of claim 11 in which the envelope signal is carried on an optical carrier.

13. The logarithmic amplifier of claim 1 in which the low gain section has a gain path having a signal limiter with a larger limiting level than the limiting level of the signal limiters in the high gain section.

14. A logarithmic amplifier receiving an input voltage, comprising:

plural gain paths, one of the gain paths being a highest gain path and the highest gain path containing N amplifiers, where N is an integer greater than one, each gain path including an amplifier and a signal limiter in series, and each gain path being connected to a common input such that the paths are in parallel, each of the gain paths having an output and a gain;

the outputs of the plural gain paths being connected to a signal summation circuit and summed to form an output signal;

at least two of the plural gain paths sharing a common amplifier such that signals in the at least two of the plural gain paths are amplified by the common amplifier and such that the logarithmic amplifier has at least N+2 gain paths;

a low gain section connected between the common input and the signal summation circuit;

delay elements in the plural gain paths, the delays of the delay elements being selected to compensate for variation between group and phase delay of the plural gain paths, the delay elements of at least two of the plural gain paths sharing the common amplifier such that signals in the delay elements of at least two of the plural gain paths are being amplified by the common amplifier; and the gain of each of the plural gain paths and the low gain section being selected so that the output signal varies logarithmically with the input voltage.

15. The logarithmic amplifier of claim 14 in which the highest gain path in the high gain section comprises at least two series connected amplifiers.

16. The logarithmic amplifier of claim 15 in which the gain of the series connected amplifiers is distributed with higher gain closer to the common input.

17. The logarithmic amplifier of claim 14 in which the highest gain path in the high gain section shares an amplifier with the next highest gain path in the high gain section such that signals in the highest rain path in the high gain section and the next highest gain path in the high gain Section are amplified by a common amplifier.

18. The logarithmic amplifier of claim 14 in which each gain path in the high gain section shares an amplifier with another gain path in the high gain section such that signals in the each gain path in the high gain section and the another gain path in the high gain section are amplified by a common amplifier.

19. The logarithmic amplifier of claim 18 in which the minimum number of amplifiers is used by sharing of amplifiers in the high gain section such that signals in the high rain section are amplified by common amplifiers to obtain a desired gain bandwidth product.

20. The logarithmic amplifier of claim 14 further comprising an amplifier on the common input to the high gain section and low gain section.

21. The logarithmic amplifier of claim 14 in which the gains of the gain paths are selected such that the ratio of succeeding gains in the gain paths is a function of A-1 where A is equal to $D^{1/N}$, D is the dynamic range of the logarithmic amplifier and N is the number of gain paths in the logarithmic amplifier.

22. The logarithmic amplifier of claim 14 in which the common input is connected to a source of an information signal.

23. The logarithmic amplifier of claim 22 in combination with a series connected Hubert transformer to produce a control signal that is output to a phase modulator and combined with an envelope signal to produce a single sideband signal.

24. The logarithmic amplifier of claim 23 in which the envelope signal is carried on an optical carrier.

25. The logarithmic amplifier of claim 14 in which the low gain section has a gain path having a signal limiter with a larger limiting level than the limiting levels of the signal limiters in the high gain section.

26. A logarithmic amplifier, comprising:

plural limiting gain stages connected together, the plural limiting gain stages having an input for receiving an input signal, comprising at least One amplifier in series with a limiting amplifier, and being connected together to an output for producing an output signal, each limiting gain stage having a gain selected so that the output signal vanes logarithmically with the input signal;

the plural limiting gain stages are connected in parallel to a common input and to a common summing output to form multiple parallel gain paths of a piece-wise approximate logarithmic amplifier;

each of the plural limiting gain stages comprising a parallel feedback amplifier; and at least two of the plural limiting gain stages sharing a common amplifier such that signals in the at least two of the plural limiting gain stages are amplified by the common amplifier.

27. The logarithmic amplifier of claim 26 in which the plural limiting gain stages include a highest gain stage, and the highest gain stage incorporates at least two series connected amplifiers.

28. The logarithmic amplifier of claim 27 in which the highest gain stage shares a common amplifier with the next highest gain stage such that signals in the highest gain and the next highest gain stage are amplified by a common amplifier.

29. The logarithmic amplifier of claim 28 in which the gains of the gain stages are selected such that the ratio of succeeding gains in the gain stages is a function of A-1 where A is equal to $D^{1/N}$, D is the dynamic range of the logarithmic amplifier and N is the number of stages in the logarithmic amplifier.

30. The logarithmic amplifier of claim 26 in which the input is connected to a source of an information signal.

31. The logarithmic amplifier of clam 30 in combination with a series connected Hubert transformer to produce a control signal that is output to a phase modulalor and combined with an envelope signal to produce a single sideband signal.

32. The logarithmic amplifier of claim 31 in which the envelope signal is carried on an optical carrier.

* * * * *

UNITED STATES PATENT AND TRADEMARK OFFICE

CERTIFICATE OF CORRECTION

PATENT NO. : 6,734,712 B2
DATED : May 11, 2004
INVENTOR(S) : C.D. Holdenried et al.

It is certified that error appears in the above-identified patent and that said Letters Patent is hereby corrected as shown below:

Title page,
Item [56], References Cited, OTHER PUBLICATIONS, last reference,
"(0.5 t0 1.5" should read -- (0.5 to 1.5 --

Column 16,
Lines 26 and 37, "rain" should read -- gain --
Line 27, "Section" should read -- section --
Line 66, "One" should read -- one --

Column 17,
Line 3, "vanes" should read -- varies --

Signed and Sealed this

Twenty-fourth Day of August, 2004

JON W. DUDAS
*Director of the United States Patent and Trademark Office*